US006215971B1

(12) United States Patent
Sakoh et al.

(10) Patent No.: US 6,215,971 B1
(45) Date of Patent: Apr. 10, 2001

(54) ELECTROPHOTOGRAPHIC IMAGE-FORMING METHOD, ELECTROPHOTOGRAPHIC IMAGE-FORMING APPARATUS, AND PROCESS CARTRIDGE

(75) Inventors: Harumi Sakoh; Haruyuki Tsuji, both of Yokohama; Shinji Takagi, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,848

(22) Filed: Mar. 28, 2000

(30) Foreign Application Priority Data

| | | |
|---|---|---|
| Mar. 29, 1999 | (JP) | 11-086836 |
| Apr. 5, 1999 | (JP) | 11-098098 |
| Oct. 28, 1999 | (JP) | 11-306920 |

(51) Int. Cl.[7] ..... G03G 15/00; G03G 15/30

(52) U.S. Cl. ..... 399/159; 399/111; 399/149; 430/31

(58) Field of Search ..... 399/159, 149, 399/111; 430/31, 56

(56) References Cited

U.S. PATENT DOCUMENTS

| | | | |
|---|---|---|---|
| 4,702,986 | * 10/1987 | Imai et al. . | |
| 6,021,291 | 2/2000 | Karakama et al. | 399/104 |
| 6,038,414 | 3/2000 | Inami et al. | 399/106 |
| 6,044,237 | 3/2000 | Numagami et al. | 399/104 |

FOREIGN PATENT DOCUMENTS

| | | |
|---|---|---|
| 0 715 230 A1 | 6/1996 | (EP) . |
| 0 818 714 A1 | 1/1998 | (EP) . |
| 48-47345 | 7/1973 | (JP) . |
| 52-19535 | 2/1977 | (JP) . |
| 56-128956 | 10/1981 | (JP) . |
| 61-275862 | 12/1986 | (JP) . |
| 61-275863 | 12/1986 | (JP) . |
| 4-40467 | 2/1992 | (JP) . |
| 4-241359 | 8/1992 | (JP) . |
| 4-337739 | 11/1992 | (JP) . |
| 4-348354 | 12/1992 | (JP) . |
| 5-69155 | 3/1993 | (JP) . |
| 5-72797 | 3/1993 | (JP) . |
| 6-130711 | 5/1994 | (JP) . |
| 10-254295 | 9/1998 | (JP) . |

* cited by examiner

*Primary Examiner*—Susan S. Y. Lee
(74) *Attorney, Agent, or Firm*—Fitzpatrick, Cella, Harper & Scinto

(57) ABSTRACT

An electrophotographic image-forming method has a contact charging step of charging the surface of an electrophotographic photosensitive member; an electrostatic latent image forming step of forming an electrostatic latent image on the surface of the electrophotographic photosensitive member charged; a developing step of developing the electrostatic latent image formed into a toner image; and a transfer step of transferring the toner image formed by the development from the electrophotographic photosensitive member to a transfer material, the developing step serving also as a cleaning step for collecting a toner remaining on the electrophotographic photosensitive member after transfer. The toner contains an external additive and the electrophotographic photosensitive member has surface properties of universal hardness of 200 N/mm$^2$ or above (provided that a curve that represents the relationship between hardness and depth of indentation by an indenter has no point of inflection) and a coefficient of surface friction of from 0.01 to 1.2.

24 Claims, 7 Drawing Sheets

ELECTROPHOTOGRAPHIC IMAGE-FORMING METHOD, ELECTROPHOTOGRAPHIC IMAGE-FORMING APPARATUS, AND PROCESS CARTRIDGE

BACKGROUND OF THE INVENTION

1. Field of the Invention

This invention relates to an electrophotographic image-forming method called a "cleanerless system" in which the toner remaining on an electrophotographic photosensitive member after transfer is collected in at least the step of development so that any means exclusively used for cleaning can be omitted from assemblage; an electrophotographic image-forming appratus employing such a method; and a process cartridge used in this apparatus.

2. Related Background Art

Transfer type image-forming apparatuses (such as electrophotographic copying machines, fax machines and laser beam printers) are in wide use. They form images by forming on the surface of an electrophotographic photosensitive member (hereinafter often "photosensitive member") a toner image by an appropriate image-forming process and transferring the toner image to a transfer material such as paper, and fixing the transferred image to output an image-formed material (such as a copy or a print). The photosensitive member is repeatedly used for image formation.

In the transfer type image-forming apparatus, when the transfer of toner images from the photosensitive member side to the transfer material side is carried out, not all toner is transferred, but actually some part of the toner remains on the photosensitive member. The toner remaining on the photosensitive member is called "transfer residual toner." The transfer residual toner must be removed from the surface of the photosensitive member so that high-quality images free of stains, etc. can be obtained in repeated image-forming processes. Accordingly, it is necessary to remove the transfer residual toner from the surface of the photosensitive member (photosensitive member cleaning). It is common to provide an assembly exclusively used for cleaning (i.e., cleaner) such as a cleaning blade to remove the transfer residual toner from the surface of the photosensitive member.

In recent years, transfer type image-forming apparatus employing a cleanerless system have come into use in which the transfer residual toner remaining on the photosensitive member after transfer is collected in at least the development step and is reused (i.e., cleaning-at-development).

The image-forming apparatuses employing such a cleanerless system are effective in view of ecology and also enable image-forming apparatuses to be made small-sized, light-weight and low-cost.

Meanwhile, as a charging means for uniformly charging the photosensitive member to stated polarity and potential, corona charging assemblies have commonly been used. This is a means in which a corona charging assembly is provided in non-contact and face to face relationship with a photosensitive member, and the surface of the photosensitive member is exposed to a corona shower generated from the corona charging assembly to which high voltage is applied.

In recent years, rather than such charging assemblies, contact charging assemblies are brought into practical use because of their advantages of, e.g., low ozone and low power consumption.

In the contact charging assemblies, a conductive charging member (contact charging member) of a blade type or a fur brush type is brought into contact with a charging target such as the photosensitive member, and a stated charging voltage (charging bias) is applied to this contact charging member to charge the charging target to stated polarity and potential.

In the charging structure (the mechanism of charging), two types, a corona charging type and an injection charging type, stand intermingled. Which performance comes out depends on which is predominant.

In an image-forming apparatus employing a cleanerless system which makes use of such a contact charging assembly as a charging means for the photosensitive member, the transfer residual toner on the photosensitive member is carried to an area where the contact charging member and the photosensitive member come into contact (i.e., a charging zone) and adheres to and mingles with the contact charging member, thus it is temporarily collected by the contact charging member (i.e., cleaning-at-charging).

The toner collected by the contact charging member is, after its charge polarity is adjusted, successively electrically sent out from the contact charging member onto the photosensitive member.

The toner sent out from the contact charging member onto the photosensitive member is carried to a developing zone, which is an area where a developing assembly as a developing means faces the photosensitive member, and is collected at the developing assembly (cleaning-at-development) and reused.

In the cleaning-at-development, the transfer residual toner on the photosensitive member can be collected by the aid of a fog-removing bias (a defogging potential difference Vback which is a potential difference intermediate between the DC component applied to a developing member of the developing assembly and the surface potential of the photosensitive member) at the time of the next and subsequent development on the photosensitive member.

Incidentally, the toner sent out from the contact charging member onto the photosensitive member is usually in a small quantity and in a state of a very thin layer standing scattered uniformly, and does not substantially adversely affect the next step of imagewise exposure. Also, ghost images caused by transfer residual toner patterns are also prevented from occurring.

The transfer residual toner on the photosensitive member often comes to have a charge polarity reversed as a result of, e.g., discharging at the time of transfer. For the toner whose polarity is reversed, it is difficult to collect at the developing assembly simultaneously with development (i.e., by cleaning-at-development). The contact charging member takes in toner containing such toner whose polarity has turned reverse, adjusts it to a regularly charged toner and then sends out the toner onto the photosensitive member. Hence, the transfer residual toner can be collected easily at the developing assembly simultaneously with development.

In order to satisfy various performances, metal oxides commonly called external additives are added to toners. For example, as disclosed in Japanese Patent Application Laid-Open No. 61-275862 and No. 61-275863, it is proposed that alumina having been made hydrophobic is used to stabilize triboelectric chargeability of toners.

Japanese Patent Application Laid-Open No. 48-47345 proposes a metal oxide powder as an abrasive; and Japanese Patent Application Laid-Open No. 52-19535 and No. 56-128956, a metal oxide such as titanium oxide as a flowability-providing agent. Also, Japanese Patent Application Laid-Open No. 4-337739, No. 4-348354, No. 4-40467 and No. 5-72797 discloses use of a surface-treated amorphous titanium oxide powder for the purposes of imparting flowability, stabilizing the chargeability of toners and preventing toners from causing filming.

These are all inorganic matters, and may rub the surface of the photosensitive member to cause wear of the photosensitive member surface.

When such a toner with an external additive is used in the above image-forming apparatus of cleanerless system making use of the contact charging assembly as a charging means for the photosensitive member, the transfer residual toner on the photosensitive member is carried to the contact charging member/photosensitive member contact area (the charging zone) and adheres to and mingles with the contact charging member. Hence, there is such a problem that the external additive tends to rub and wear the photosensitive member at the contact charging member/photosensitive member contact area, consequently tending to especially cause faulty images.

SUMMARY OF THE INVENTION

The present invention was made from the viewpoint as stated above. Accordingly, in an electrophotographic image-forming method employing a transfer system making use of a toner with an external additive and a cleanerless system in which the transfer residual toner on the photosensitive member is collected in at least the step of development, an electrophotographic image-forming appratus employing such a method, and a process cartridge used in this apparatus, an object of the present invention is to provide an electrophotographic image-forming method which can prevent the photosensitive member from being flawed and worn so that any faulty images due to flaws and wear may not occur, and can give high-quality images in small-sized, light-weight and low-cost machines. Also disclosed are an electrophotographic image-forming apparatus and a process cartridge which employ such a method.

To achieve the above object, the present invention provides an electrophotographic image-forming method comprising a contact charging step of charging the surface of an electrophotographic photosensitive member; an electrostatic latent image forming step of forming an electrostatic latent image on the surface of the electrophotographic photosensitive member charged; a developing step of developing the electrostatic latent image formed, into a toner image; and a transfer step of transferring the toner image formed by the development, from the electrophotographic photosensitive member to a transfer material;

the developing step serving also as a cleaning step for collecting a toner remaining on the electrophotographic photosensitive member after transfer;

the toner containing an external additive; and the electrophotographic photosensitive member having such surface properties that universal hardness is 200 $N/mm^2$ or above (provided that a curve that represents the relationship between hardness and depth of indentation by an indenter has no point of inflection) and a coefficient of surface friction is from 0.01 to 1.2.

The present invention also provides an electrophotographic image-forming apparatus comprising a contact charging means for charging the surface of an electrophotographic photosensitive member; an electrostatic latent image forming means for forming an electrostatic latent image on the surface of the electrophotographic photosensitive member thus charged; a developing means for developing the electrostatic latent image thus formed, into a toner image; and a transfer means for transferring the toner image formed by the development, from the electrophotographic photosensitive member to a transfer material;

the developing means serving also as a cleaning means for collecting a toner remaining on the electrophotographic photosensitive member after transfer;

the toner containing an external additive; and the electrophotographic photosensitive member having such surface properties that universal hardness is 200 $N/mm^2$ or above (provided that a curve that represents the relationship between hardness and depth of indentation by an indenter has no point of inflection) and a coefficient of surface friction is from 0.01 to 1.2.

The present invention still also provides a process cartridge comprising a contact charging means for charging the surface of an electrophotographic photosensitive member; an electrostatic latent image forming means for forming an electrostatic latent image on the surface of the electrophotographic photosensitive member charged; and a developing means for developing the electrostatic latent image formed, into a toner image;

the developing means serving also as a cleaning means for collecting a toner remaining on the electrophotographic photosensitive member after transfer;

the electrophotographic photosensitive member, the contact charging means and the developing means being supported as one unit and being detachably mountable to the main body of an image-forming apparatus;

the toner containing an external additive; and the electrophotographic photosensitive member having such surface properties that universal hardness is 200 $N/mm^2$ or above (provided that a curve that represents the relationship between hardness and depth of indentation by an indenter has no point of inflection) and a coefficient of surface friction is from 0.01 to 1.2.

DESCRIPTION OF THE PREFERRED EMBODIMENTS

The electrophotographic image-forming method of the present invention comprises a contact charging step of charging the surface of an electrophotographic photosensitive member; an electrostatic latent image forming step of forming an electrostatic latent image on the surface of the electrophotographic photosensitive member charged; a developing step of developing the electrostatic latent image formed, into a toner image; and a transfer step of transferring the toner image formed by the development, from the electrophotographic photosensitive member to a transfer material. The developing step serves also as a cleaning step for collecting toner remaining on the electrophotographic photosensitive member after transfer, where the toner contains an external additive, and the electrophotographic photosensitive member has such surface properties that universal hardness is 200 $N/mm^2$ or above (provided that a curve that represents the relationship between hardness and depth of indentation by an indenter has no point of inflection) and a coefficient of surface friction is from 0.01 to 1.2.

The electrophotographic image-forming apparatus of the present invention carries out the above image-forming method, and the process cartridge is used in such an apparatus.

In the present invention, the transfer residual toner on the surface of the photosensitive member is collected in at least the developing step. The transfer residual toner is collected finally in the developing step. It may preferably be collected in both the charging step and the developing step. The collection of toner in the charging and developing steps may be made by the manner of collection described above as the prior art.

The present invention employs an electrophotographic photosensitive member having specific surface properties, so as to solve the technical problem especially remarkable in the specific process as stated above, i.e., the technical problem peculiar to the cleanerless system making use of the contact charging and the toner having an external additive.

Figure 4:
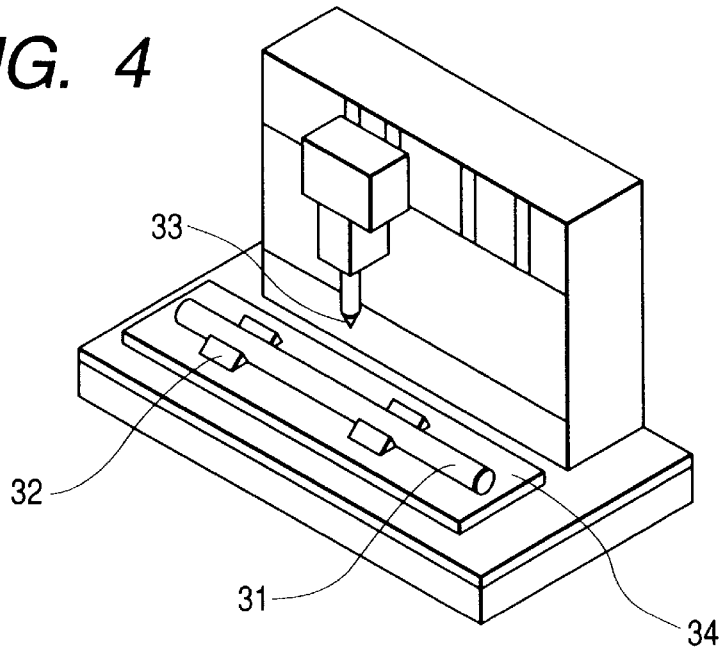
FIG. 4 schematically illustrates a measuring instrument used in a test on surface film properties.

The universal hardness in the present invention can be determined by the following surface film properties test. The surface film properties test is a test for analyzing the hardness of thin films, cured films, organic films and so forth. To make measurement, a tester shown in FIG. 4 (FISCHER SCOPE H100V, trade name; manufactured by Fischer Instruments Co.) may be used. Using a diamond indenter 33 which is a quadrangular-pyramid diamond indenter whose angle between the opposite faces is set at 136°, a measurement load is stepwise applied to a sample (electrophotographic photosensitive member) 31 to press the indenter into the sample film, where depth of indentation by the indenter h under application of the load is electrically detected and read. In FIG. 4, reference numeral 34 denotes a movable table; and 32, a sample stand.

Figure 5:
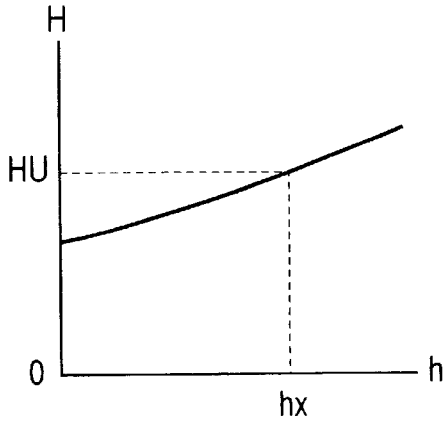
FIG. 5 illustrates an example in which there is no point of inflection in a curve that represents the relationship between hardness (H) and depth of indentation by an indenter (h) in a test on surface film properties made for a surface layer.
Figure 6:
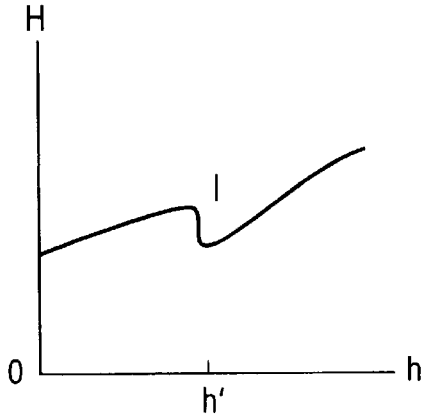
FIG. 6 illustrates an example in which there is a point of inflection 1 in a curve that represents the relationship between hardness (H) and depth of indentation by an indenter (h) in a test on surface film properties made for a surface layer.

Hardness H is indicated as a value obtained by dividing the test load by the surface area of a dent produced by the test load. Universal hardness HU is indicated as a hardness at a preset maximum indentation depth hx (in the present invention, hx=1 $\mu$m). In the hardness H and the universal hardness HU, it means that, the larger each value is, the higher the film hardness is (see FIG. 5). However, in the curve that represents the relationship between the hardness H and the depth of indentation by the indenter h in the surface film properties test, the curve may have in some cases a point of inflection 1 as shown in FIG. 6, which shows an abrupt change of the hardness H at an indentation depth h'. This means that the film has broken or cracked at the point of the indentation depth h'. Films whose surfaces may crack in this way tend to be deeply flawed, and are outside the scope of the present invention.

Figure 7:
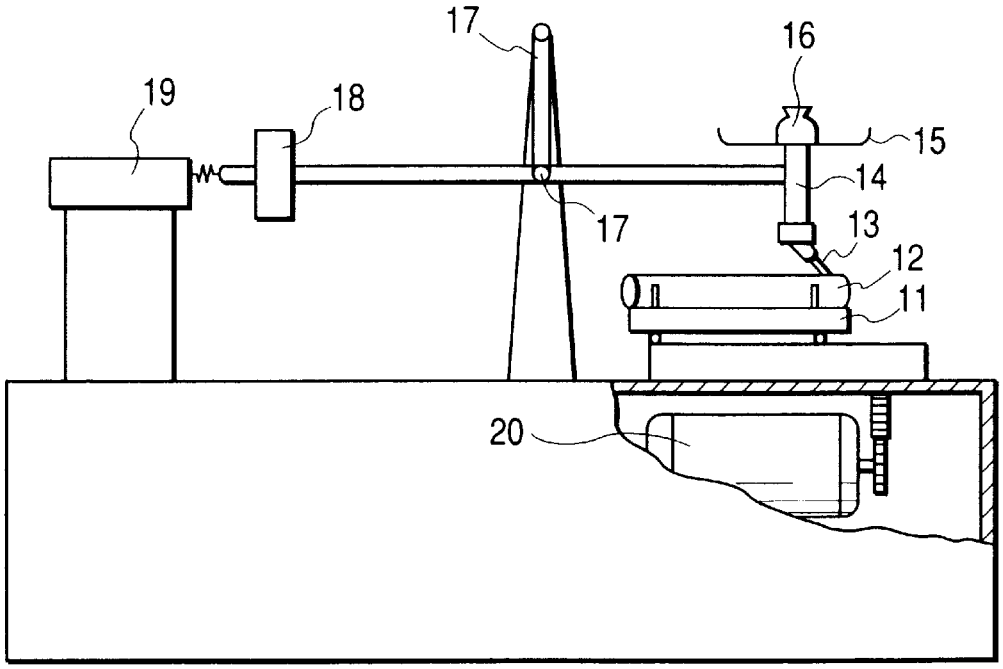
FIG. 7 schematically illustrates a friction coefficient measuring instrument Haydon 14 model.
Figure 8:
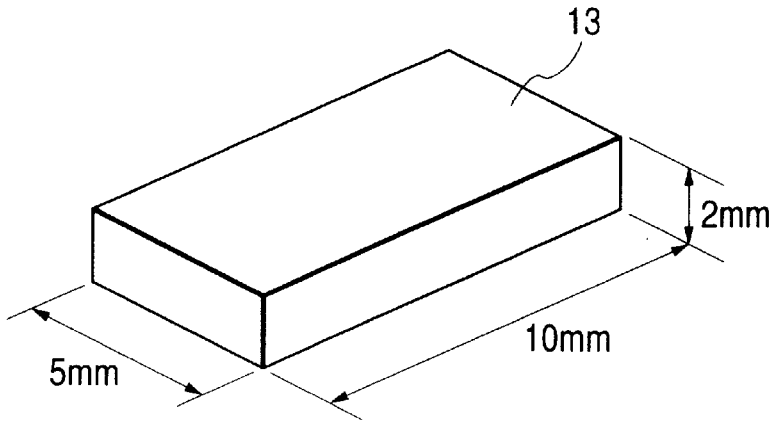
FIG. 8 illustrates the shape of an urethane rubber blade used in the measurement of a coefficient of friction.
Figure 9:
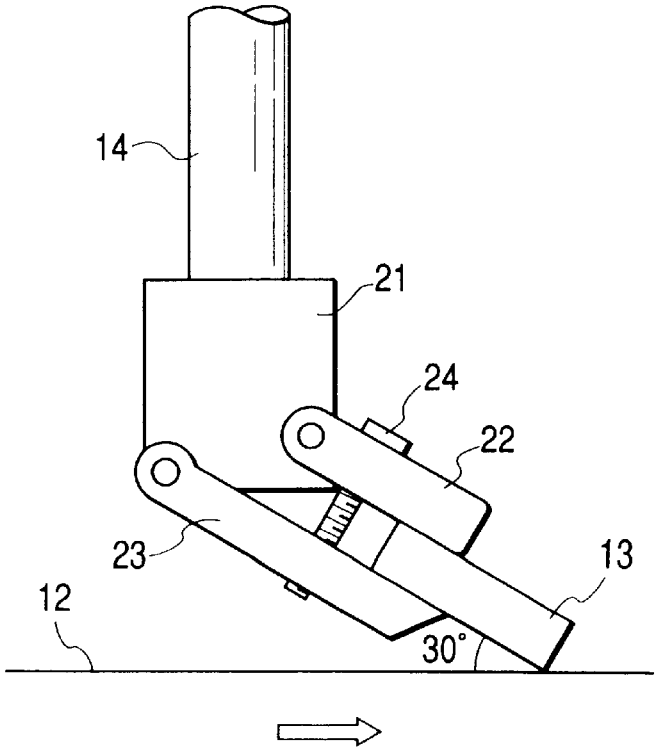
FIG. 9 is an enlarged view illustrating how the urethane rubber blade shown in FIG. 7 comes into contact with a sample.

The coefficient of surface friction in the present invention is measured in the following way. A measuring instrument used is a surface properties tester Model 14, manufactured by Haydon Co., which has been remodeled as shown in FIG. 7, for the measurement on drum-shaped samples. In FIG. 7, reference numeral 12 denotes a sample. Selection of a sample stand 11 enables measurements to be made on any of drum-shaped samples and flat-plate samples. In the measurement of the coefficient of surface friction, a urethane rubber blade 13 is used. The urethane rubber blade 13 (BANKORAN, trade name, available from Bando Chemical Industries, Ltd.) has a rubber hardness of 65±3°, and has dimensions of 5 mm wide, 10 mm long and 2 mm thick as shown in FIG. 8. FIG. 9 is an enlarged view illustrating how the urethane rubber blade 13 comes into contact with the sample. The blade 13 is fixed with a fixing screw 24 between an upper holder 22 and a lower holder 23, the former being connected to a holder-supporting arm 21 provided at an end of a column 14; it is fixed at a free length (the length of the part not held by the holders 22 and 23 of the blade 13) of 8 mm in such a way that its contact angle to the sample 12 comes to be 30°.

To make measurements, a load of 10 g is applied to the blade 13 through the column 14 by means of a weight 16 placed on a pan 15, and a sample drum (electrophotographic photosensitive member) is moved together with the sample stand 11 to which it is kept fixed; it is moved by means of a motor 20 in the direction forward to the blade 13 and in the generatrix direction. The load put at this time is read as a frictional force by a mechanism constituted of a support point 17, a balancer 18 and a load transducer 19 as shown in FIG. 17. Also, a 25 $\mu$m thick film of polyethylene terephthalate (MYLAR, trade name; available from Du Pont) is used as a reference sample, and is wound around a cylinder having the same diameter of the sample, to measure the frictional force under the same conditions as those for the sample. The coefficient of surface friction of the sample is calculated according to the following expression (I).

Expression (I)

$$\text{Coefficient of surface friction} = \frac{\text{frictional force on sample}}{\text{frictional force on polythylene terephthalate film}}.$$

Since the coefficient of surface friction is on the basis of the polyethylene terephthalate film, it is not affected by some non-uniformity of measurement conditions. It is also not affected by the diameter of a photosensitive drum, showing a constant value.

In the present invention, the measurement conditions are tolerable in the following range.

(1) Urethane Rubber

Hardness: 62 to 72°; thickness: 1 to 5 mm;

manufacturers: Bando Chemical Industries, Ltd., Hokushin Gomu K. K., Tokai Rubber Industries, Ltd. and so forth.

(2) Polyethylene Terephthalate Film

Manufacturers: Toray Industries, Inc. (trade name: LUMILAR), Teijin Limited (trade name: TR8550), Du Pont (trade name: MAYLAR) and so forth; thickness: 10 to 50 $\mu$m.

(3) Drum Diameter: 20 to 200 mm (changing the drum diameter does not result in any change in the coefficient of surface friction on the basis of polyethylene terephthalate film).

Evaluation of surface properties in the present invention is all made at room temperature (about 21 to 25° C.).

Studies made by the present inventors have revealed that an electrophotographic photosensitive member having such surface properties that the universal hardness HU is 200 N/mm$^2$ or above, and preferably 220 N/mm$^2$ or above, and the coefficient of surface friction is from 0.01 to 1.2, and preferably from 0.02 to 1.1 is used, whereby any great flaws may not occur on the photosensitive member and faulty images can be prevented even in the cleanerless system. There are no particular limitations on the upper limit of the universal hardness HU. It may be about 350 N/mm$^2$ as the upper limit.

If the universal hardness HU is less than 200 N/mm$^2$, the external additive having adhered to and mingled with the contact charging member of the contact charging means simultaneously with the transfer residual toner may greatly wear the photosensitive member when the contact charging member rubs the photosensitive member surface, to cause flaws or result in abrasion in a large quantity, making short the lifetime for maintaining the running performance of photosensitive members.

Even though the universal hardness HU is 200 N/mm$^2$ or above, the photosensitive member surface may have a low lubricity to the contact charging member and be rubbed strongly if the coefficient of surface friction is larger than 1.2. More specifically, it is rubbed while the external additive is strongly pressed against it, resulting in abrasion in a large quantity or causing many flaws to make short the lifetime for maintaining the running performance of photosensitive members.

On the other hand, if the coefficient of surface friction is as very small as less than 0.01, the rubbing force may barely act between the contact charging member and the photosensitive member, so that the transfer residual toner can not be scraped off by the charging member. Hence, ghost images caused by transfer residual toner patterns tend to occur.

In the present invention, the photosensitive member may further have such surface properties that its contact angle to pure water is 95 degrees or larger. This is preferable because the meritorious effects of the present invention can be obtained more remarkably. In addition, the upper limit of the contact angle to pure water may preferably be less than 120.

The contact angle is defined to be an angle formed by the liquid surface and the photosensitive member surface (an angle inside the liquid), measured by a dropping contact angle meter at the place where the free surface of pure water comes into contact with the photosensitive member surface.

In the present invention, the surface of the photosensitive member is abraded as a result of rubbing with the contact charging member. Hence, even when the coefficient of surface friction of the photosensitive member at the initial stage is not in the range of from 0.01 to 1.2, it is embraced in the scope of the present invention as long as the coefficient of surface friction satisfies the range of from 0.01 to 1.2 after the surface layer has been removed by 0.1 $\mu$m at maximum. The same also applies to the contact angle.

Figure 2:
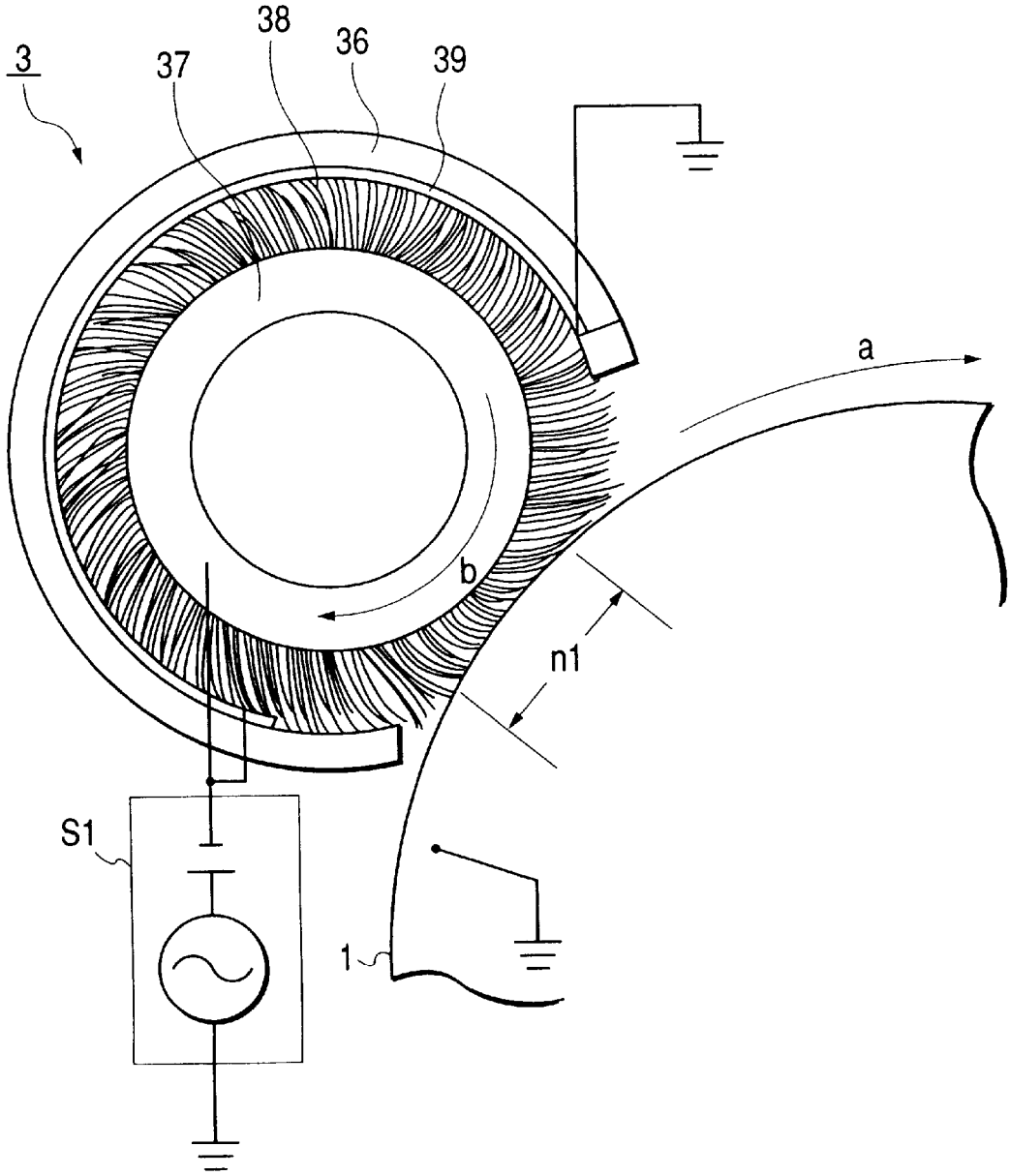
FIG. 2 is an enlarged transverse-sectional diagrammatic view of the part including a fur-brush charging assembly 3 in the image-forming apparatus shown in FIG. 1.
Figure 3:
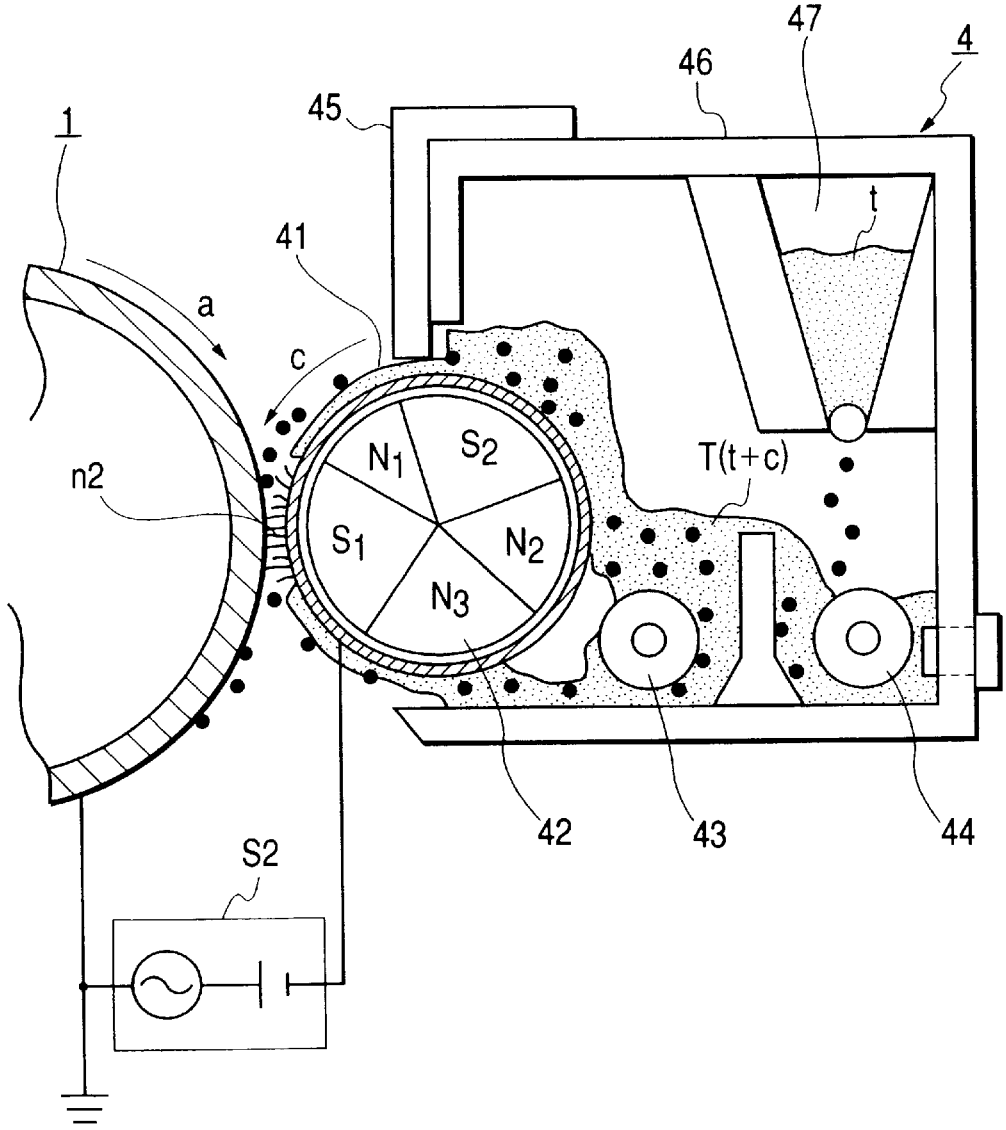
FIG. 3 is an enlarged transverse-sectional diagrammatic view of the part including a developing assembly 4 in the image-forming apparatus shown in FIG. 1.

An embodiment of the present invention will be described below in detail with reference to FIGS. 1 to 3. The present invention is by no means limited to this embodiment.

Figure 1:
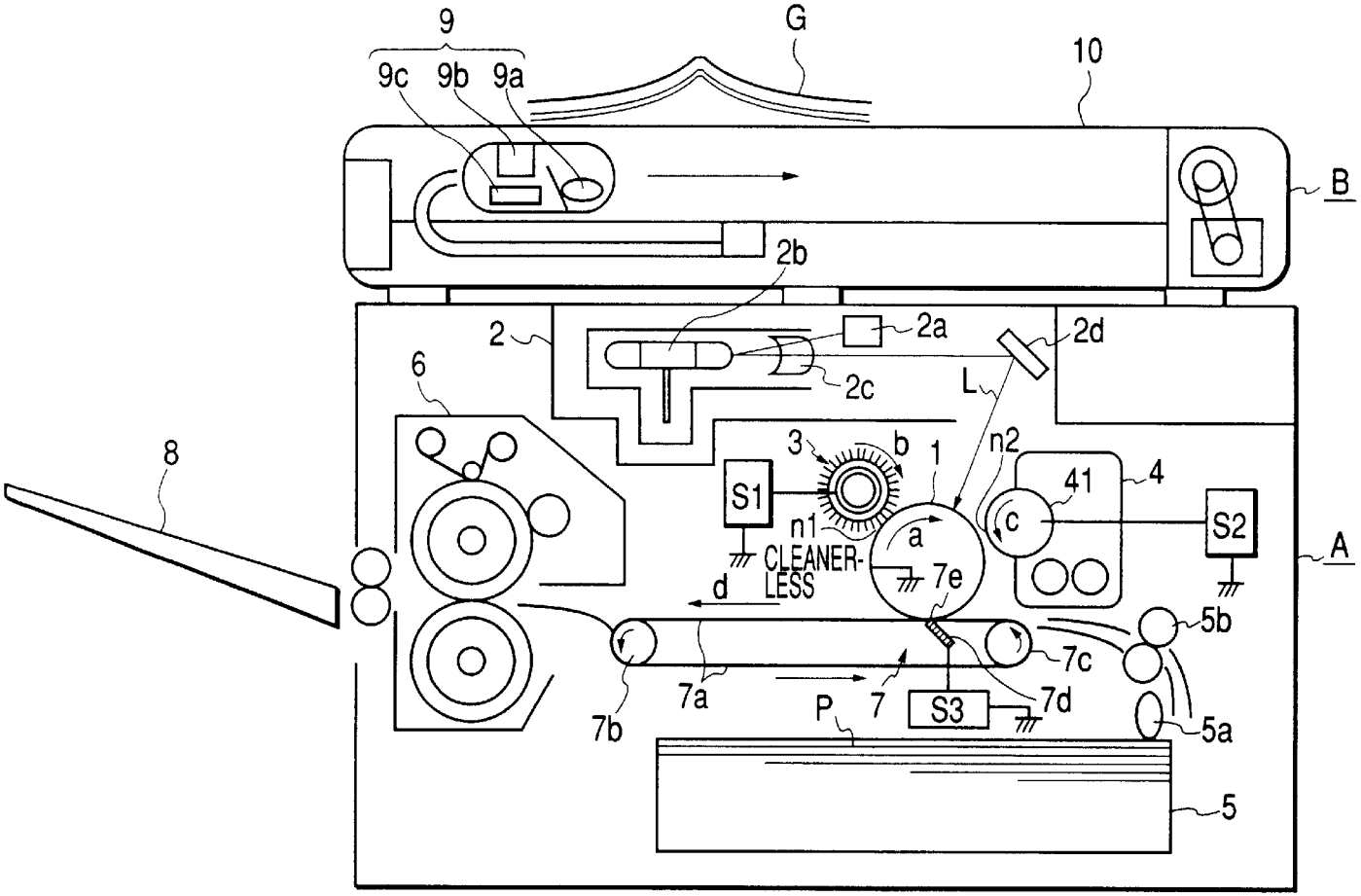
FIG. 1 schematically illustrates the construction of an example of an image-forming apparatus according to the present invention.

FIG. 1 schematically illustrates the construction of an example of an image-forming apparatus according to the present invention. The electrophotographic image-forming apparatus of this example is a laser beam printer utilizing a transfer type electrophotographic process and employing a contact charging system, a reversal development system and a cleanerless system.

Letter symbol A denotes the main body of the printer; and B, an image reader (image-reading assembly) mounted thereon.

(1) Image Reader B

In the image reader B, an original G is placed on a stationary original stand 10 (a transparent plate such as a glass plate) with the former's side to be copied facing down, and an original-press-holding plate (not shown) is covered thereon.

An image-reading unit 9 is provided with an original irradiation lamp 9*a*, a short-focus lens array 9*b* and a CCD sensor 9*c*. Upon input of copy start signals, this unit 9 is driven forwards from the home position on the left-end side (as viewed in the drawing) of the original stand toward the right-end side along the under surface of the original stand. Once it reaches the predetermined end point of the forward movement, it is driven backwards and is returned to the initial home position.

In the course of the forward movement of the unit 9, the image surface facing downwards of the original G placed on the original stand 10 is irradiated and scanned by the original irradiation lamp 9*a* successively from the left-end side toward the right-end side. The reflected light of the irradiation scanning light, reflected from the surface of the original, imagewise enters the CCD sensor 9*c* through the short-focus lens array 9*b*.

The CCD sensor 9*c* is constituted of a light-receiving section, a transmitting section and an output section. Light signals are converted to electric-charge signals at the CCD light-receiving section. At the transmitting section, the signals are successively transmitted to the output section in synchronization with clock pulses. At the output section, the electric-charge signals are converted to voltage signals, which are then amplified, made a low-impedance and outputted. Analog signals thus obtained are subjected to known image processing and converted into digital signals, which are then sent to the printer main body A.

In short, the image information of the original G is photoelectrically read as time-sequential electric digital pixel signals (image signals) by the image reader B.

(2) Printer Main Body

A rotating drum type electrophotographic photosensitive member 1 is rotatively driven in the direction of an arrow a at a stated peripheral speed (process speed) around the center shaft. A photosensitive member 1 of the present example is a photosensitive member having a diameter of about 30 mm, and is rotatively driven at a peripheral speed of 100 mm/sec. This photosensitive member 1 will be detailed in item (3) given later.

The photosensitive member 1 is, in the course of its rotation, uniformly primarily charged to stated polarity and potential by means of a fur-brush contact charging assembly 3 in the present example. In the present example, it is uniformly primarily charged to about −700 V. The fur-brush contact charging assembly 3 as a contact charging means will be detailed in item (4) given later.

Then, using a laser exposure means (laser scanner) 2, the uniformly charged surface of the rotating photosensitive member 1 is subjected to scanning exposure to laser light L modulated in accordance with the image signals sent from the image reader B side to the printer main body A side, whereupon electrostatic latent images corresponding to the image information of the original G, read photoelectrically by the image reader B, are sequentially formed on on the surface of the rotating photosensitive member 1.

The laser exposure means 2 consists of a solid-state laser device 2*a*, a rotary polygonal mirror (polygon mirror) 2*b*, a group of f-θ lenses 2*c*, and a polarizing mirror 2*d* and so forth. In accordance with the image signals having been inputted, the solid-state laser device 2*a* is controlled in ON/OFF light emission at predetermined timing by a light-emitting signal generator (not shown). Laser light radiated from the solid-state laser device 2*a* is converted to substantially parallel light fluxes by a collimeter lens system, with which light fluxes the photosensitive member surface is scanned by the rotary polygonal mirror 2*b*, rotating at a high speed, and simultaneously images are spotwise formed on the photosensitive member via the f-θ lens group 2*c* and polarizing mirror 2*d*.

As a result of such laser light scanning, an exposure distribution for the portion of one scanning is formed on the surface of the photosensitive member 1. Then, as a result of secondary scanning by the rotation of the photosensitive member, an exposure distribution for the portion of image signals is obtained on the surface of the rotating photosensitive member 1. That is, the uniformly charged surface of the rotating photosensitive member 1 is scanned by the high-speed rotating rotary polygonal mirror 2*b* with the light of the solid-state laser device 2*a* which is controlled in ON/OFF light emission correspondingly to the image signals, whereupon the electrostatic latent images corresponding to scanning-exposed patterns are sequentially formed on the surface of the rotating photosensitive member 1. Namely, the electrostatic latent images corresponding to scanning-exposed patterns are formed on on the surface of the rotating photosensitive member 1 when the potential drops at exposed areas irradiated by the laser light (i.e., light-area potential) and a contrast to the potential at unexposed areas not irradiated by that light (i.e., dark-area potential) is formed.

The electrostatic latent images formed on the surface of the rotating photosensitive member 1 are, in the present example, sequentially reverse-developed on as toner images by means of a developing assembly 4. Construction of the developing assembly 4 will be detailed in item (5) given later.

Transfer materials P loaded and held in a paper feed cassette 5 are fed while being sent out sheet by sheet by means of the paper feed roller 5*a*. Each transfer material P is fed by resist rollers 5*b* to a transfer zone 7*e* which is a contact nip between the photosensitive member 1 and a transfer means transfer assembly 7 at a stated control timing, and the toner images held on the side of the photosensitive member 1 surface are electrostatically transferred to the surface of the transfer material P.

The transfer assembly 7 in the present example is a belt type transfer assembly. An endless transfer belt 7*a* is stretched across a drive roller 7*b* and a follower roller 7*c*, and is circularly driven in the direction of an arrow d at substantially the same peripheral speed as the rotational peripheral speed of the photosensitive member 1. Inside the endless transfer belt 7*a*, the transfer assembly has a transfer charging blade 7*d*. With this blade 7*d*, the belt portion on the upward traveling side of the belt 7*a* is brought into contact with the surface of the photosensitive member 1 at its approximately middle portion so as to form the transfer zone (transfer nip) 7*e*.

The transfer material P is carried on the top surface of the belt portion of the upward traveling side of the belt 7*a* and is delivered to the transfer zone 7*e*. At the time the leading edge of the transfer material P being delivered comes into the transfer zone 7*e*, a stated transfer bias is supplied to the transfer charging blade 7*d* from a transfer bias applying power source S3. Thus the transfer material P is charged on its back to a polarity opposite to that of the toner, so that the toner images on the photosensitive member 1 are sequentially transferred on to the top surface of the transfer material P.

In the present example, the transfer is carried out in the manner as described above. As transfer methods used in the present invention, roller transfer, blade transfer or corona transfer may also be employed. These transfer methods are also applicable to image-forming apparatus making use of a drumlike or beltlike intermediate transfer member not only to form monochromatic images but also to form multi-color or full-color images by multiple transfer.

The transfer belt 7*a* serves also as a means for delivering the transfer material P from the transfer zone 7*e* to a fixing assembly 6. The transfer material P having passed the transfer zone 7*e* is separated from the surface of the rotating photosensitive member 1, and is delivered and guided by the transfer belt 7*a* to the fixing assembly 6, where the toner images are heat-fixed. Transfer materials with fixed images are sent out to a paper output tray 8 as copies or prints.

The printer main body A of the present example does not have any cleaning assembly (cleaner) exclusively used to remove the transfer residual toner remaining on the surface of the rotating photosensitive member 1 after the toner images have been transferred to the transfer material P. It is an apparatus employing a cleanerless system in which the fur-brush contact charging assembly 3 and the developing assembly 4 are made to serve also as cleaning means for collecting the transfer residual toner remaining on the surface of the photosensitive member 1. This will be detailed in item (6) given later.

Figure 10:
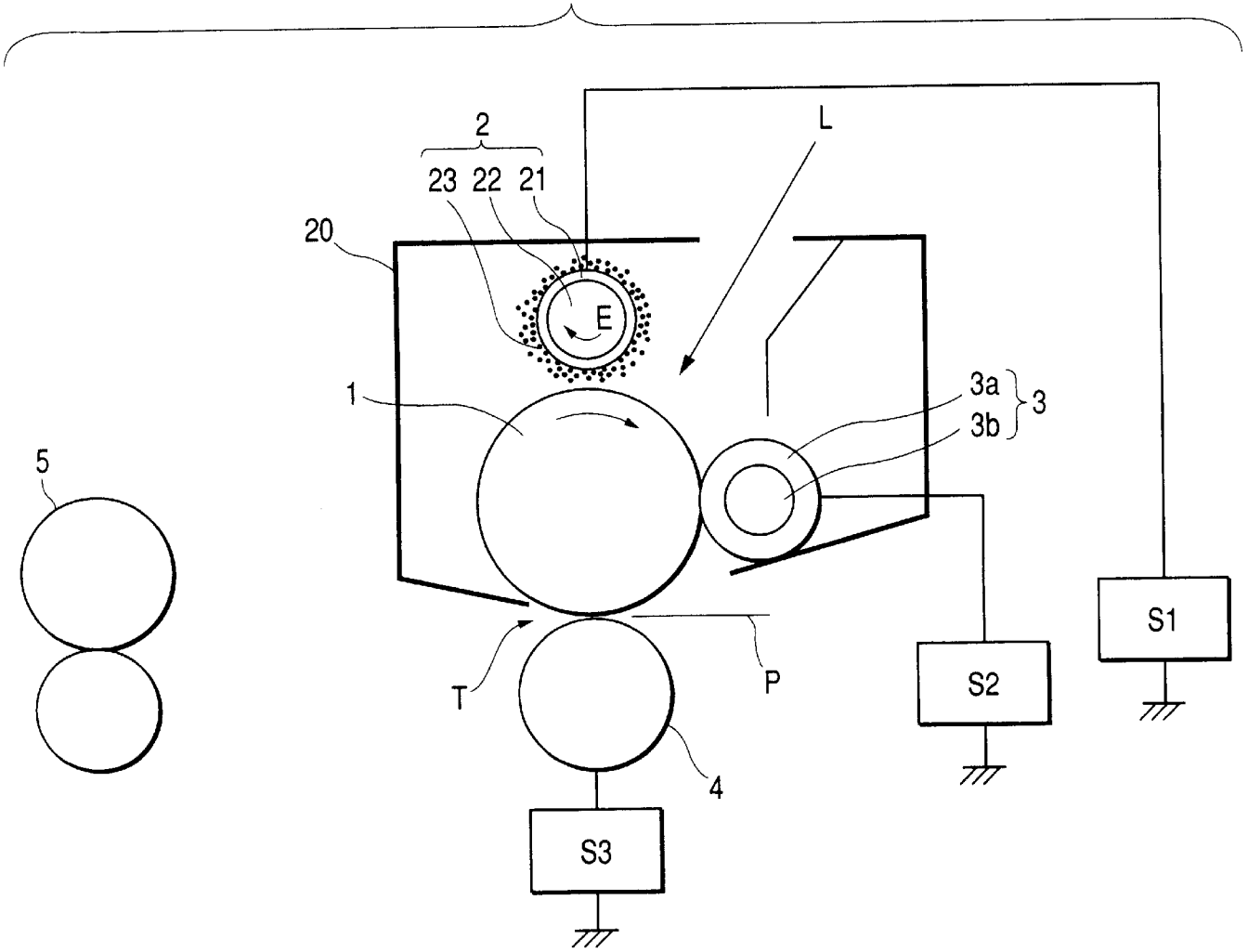
FIG. 10 is a cross-sectional diagrammatic view of an image-forming apparatus having the process cartridge of the present invention, making use of a magnetic-brush charging means as a contact charging means.

In the method and apparatus of the present invention, the processing machinery such as the photosensitive member 1, the charging means 3 and the developing assembly 4 may be set as one unit to make up a detachably mountable apparatus such as a replaceable process cartridge which is detachably mountable to the main body of an image-forming apparatus. For example, an electrophotographic photosensitive member, a contact charging means making use of a magnetic brush, and a toner-replenishable developing assembly may be supported as one unit to make up a process cartridge which is detachably mountable to the main body of an image-forming apparatus (FIG. 10). In FIG. 10, reference numeral 10 denotes a contact charging means; 21, a charging sleeve; 22, a magnet; 23, a magnetic brush formed of magnetic particles; L, exposure light; 3, a developing means; 3*a*, a developing sleeve; 3*b*, a magnet; 4, a transfer roller; P, a transfer material; T, a transfer zone; 5, a fixing means; S1 to S3, power sources; and 20, the process cartridge. Also, in the present invention, four process cartridges for yellow, magenta, cyan and black colors may be used and the respective color toner images may sequentially be transferred to the transfer material carried on the transfer belt, obtaining full-color images.

(3) Photosensitive Member 1

The electrophotographic photosensitive member used in the present invention has the surface properties as described above, i.e., the surface properties of universal hardness HU in a test on surface film properties of 200 $N/mm^2$ or above (provided that a curve that represents the relationship between hardness and depth of indentation by an indenter has no point of inflection) and a coefficient of surface friction of from 0.01 to 1.2. It may be preferred that the electrophotographic photosensitive member further has the surface properties of a contact angle with pure water of 95 degrees or larger.

The electrophotographic photosensitive member having such surface properties can be obtained in the following way. For example, with regard to the surface layer of an electrophotographic photosensitive member having usual construction, a specific resin may be used as a binder resin to control the universal hardness so as to be in the above range, and also a fluorine resin powder used in a specific quantity may be uniformly dispersed in the surface layer to control the coefficient of surface friction or the contact angle with pure water so as to be in the above range. The surface may optionally be polished.

As a means for controlling the universal hardness, it may be named that a binder resin, a charge-generating material or charge-transporting material to be dispersed or dissolved in the binder resin, or a conductive material such as a metal and an oxide, nitride, salt or alloy thereof and carbon is changed in its type and/or proportion. More specifically, though depending on materials to be dispersed in the binder resin, in the case of the materials as mentioned above, usually a larger universal hardness is achievable when the materials to be dispersed are in smaller quantities. As another means, the molecular weight, the number of polymerization functional groups or the like may be changed. More specifically, the universal hardness can be made higher by using a binder resin having a larger molecular weight. The universal hardness can also be made higher by increasing the number of polymerization functional groups to raise a degree of cross-linking. The universal hardness can still also be changed by changing the state of dispersion of the fluorine resin powder.

These factors of course affect the coefficient of surface friction and contact angle. However, any definite relationship has not been found between the universal hardness and the coefficient of surface friction or between the universal hardness and the contact angle.

In the present invention, it is important to satisfy the above surface properties. There are no particular limitations on means for its achievement. For example, as the means for controlling the coefficient of surface friction or contact angle, in addition to the selection of the types and quantities of the materials to be used, the polishing of the photosensitive member surface may be carried out.

Methods for such polishing may include, e.g., in the case when the photosensitive member is a drum type, a method in which the drum is rotated and a pressure is applied to the rotating drum while bringing a lapping tape #C-2000, available from Fuji Photo Film Co., Ltd., or a polishing film #2000 (aluminum oxide), available from Sumitomo 3M Limited, into contact with the drum surface.

As specific examples of the fluorine resin powder, it may include powders of polymers such as tetrafluorothylene, hexafluoropropylene, trifluorothylene, chlorotrifluorothylene, vinylidene fluoride, vinyl fluoride and perfluoroalkyl vinyl ethers and copolymers of any of these.

The fluorine resin powder may preferably have a number-average particle diameter ranging from 0.01 $\mu$m to 5 $\mu$m, and may preferably have a number-average molecular weight ranging from 3,000 to 5,000,000.

Usually the fluorine resin powder is used in such a state that it is dispersed in a composition used to form the outermost surface layer. In such an outermost surface layer forming composition, the fluorine resin powder may be dispersed using, e.g., a sand mill, a ball mill, a roll mill, a homogenizer, a nanomizer, a paint shaker or an ultrasonic dispersion machine. When it is dispersed, a fluorine type surface-active agent, a graft polymer and a coupling agent may auxiliarily be used.

The fluorine resin powder may preferably be contained in an amount of from 4 to 70% by weight, and more preferably from 10 to 55% by weight, based on the total weight of the composition for forming the outermost surface layer of the photosensitive member. If it is less than 4% by weight, the surface energy may lower insufficiently. If it is more than 70% by weight, the surface layer may come to have a low film strength.

The electrophotographic photosensitive member used in the present invention may have any layer configuration without any particular limitations as long as it has the above surface properties and functions as the electrophotographic photosensitive member. It is common to use a photosensitive member comprising a conductive support and a photosensitive layer provided thereon. A protective layer may be provided on the photosensitive layer. A subbing layer or a conductive layer may also be formed between the conductive support and the photosensitive layer. Accordingly, the outermost surface layer of the photosensitive member is the photosensitive layer or the protective layer. These layers are comprised of a binder resin and a charge-generating material, charge-transporting material or conductive material contained in the binder resin in an appropriate quantity. For example, the fluorine resin powder may be incorporated as described above and the surface may optionally be polished, thus the photosensitive member having the above surface properties can be obtained.

The photosensitive layer of the electrophotographic photosensitive member used in the present invention may have a single-layer or multi-layer structure. In the case of the single-layer structure, the photosensitive layer contains both a charge-generating material that generates carriers and a charge-transporting material that transports the carriers. In the case of the multi-layer structure, a charge generation layer containing the charge-generating material that generates carriers and a charge transport layer containing the charge-transporting material that transports the carriers are superposingly formed to constitute the photosensitive layer. What forms the surface layer may be either of the charge generation layer and the charge transport layer.

The single-layer photosensitive layer may preferably have a thickness of from 5 to 100 $\mu$m, and particularly preferably from 10 to 60 $\mu$m. Also, it may preferably contain the charge-generating material and charge-transporting material in an amount of from 20 to 80% by weight, and particularly preferably from 30 to 70% by weight, based on the total weight of the photosensitive layer. The single-layer photosensitive layer contains a binder resin in addition to the charge-generating material and charge-transporting material, and may optionally contain an ultraviolet light absorber, an antioxidant and other additives.

In the multi-layer photosensitive layer, the charge generation layer may preferably have a thickness of from 0.001 to 6 μm, and particularly preferably from 0.01 to 2 μm. The charge-generating material may preferably be contained in an amount of from 10 to 100% by weight, and particularly preferably from 40 to 100% by weight, based on the total weight of the photosensitive layer. The charge generation layer may be constituted of only the charge-generating material, and otherwise may contain the binder resin. The charge transport layer may preferably have a thickness of from 5 to 100 μm, and particularly preferably from 10 to 60 μm. The charge-transporting material may preferably be contained in an amount of from 20 to 80% by weight, and particularly preferably from 30 to 70% by weight, based on the total weight of the photosensitive layer. The charge transport layer may contain the binder resin in addition to the charge-transporting material, and may further contain other optional components like the above.

The charge-generating material used in the present invention may include phthalocyanine pigments, polycyclic quinone pigments, azo pigments, perylene pigments, indigo pigments, quinacridone pigments, azulenium salt dyes, squarilium dyes, cyanine dyes, pyrylium dyes, thiopyrylium dyes, xanthene dyes, quinoneimine dyes, triphenylmethane dyes, styryl dyes, selenium, selenium-tellurium, amorphous silicon and hardened cadmium.

The charge-transporting material used in the present invention may include pyrene compounds, carbazole compounds, hydrazone compounds, N,N-dialkylaniline compounds, diphenylamine compounds, triphenylamine compounds, triphenylmethane compounds, pyrazoline compounds, styryl compounds and stilbene compounds.

The binder resin used in the photosensitive layer may include polyester, polyurethane, polyallylate, polyethylene, polystyrene, polybutadiene, polycarbonate, polyamide, polypropylene, polyimide, polyamide-imide, polysulfone, polyallyl ether, polyacetal, phenolic resins, acrylic resins, silicone resins, epoxy resins, urea resins, allyl resins, alkyd resins and butyral resins. Reactive epoxy resins, or acrylic or methacrylic monomers or oligomers may also be used, which may be mixed and then cured.

The electrophotographic photosensitive member used in the present invention may have, as mentioned above, a protective layer superposingly formed on the photosensitive layer. The protective layer may preferably have a thickness of from 0.01 to 20 μm, and particularly preferably from 0.1 to 10 μm. Usually, the protective layer is comprised of a binder resin and dispersed therein a charge-generating material, a charge-transporting material or a conductive material such as a metal or an oxide, nitride, salt or alloy thereof or carbon. The binder resin, charge-generating material and charge-transporting material used in the protective layer may include the same ones as used in the photosensitive layer.

As the conductive support used in the electrophotographic photosensitive member used in the present invention, usable are metals such as iron, copper, nickel, aluminum, titanium tin, antimony, indium, lead, zinc, gold and silver, and alloys or oxides of any of these, carbon and conductive resins. It may have the shape of a cylinder, a belt or a sheet. The conductive material may be molded, or may be applied as a coating material, or may be vacuum-deposited. The conductive support used in the present example is a cylindrical support having a diameter of 30 mm as mentioned previously.

A subbing layer may also be provided between the conductive support and the photosensitive layer. The subbing layer is comprised chiefly of a binder resin, and may also contain the above conductive material or a compound having the properties of an acceptor. The binder resin used to form the subbing layer may include polyester, polyurethane, polyallylate, polyethylene, polystyrene, polybutadiene, polycarbonate, polyamide, polypropylene, polyimide, polyamide-imide, polysulfone, polyallyl ether, polyacetal, phenolic resins, acrylic resins, silicone resins, epoxy resins, urea resins, allyl resins, alkyd resins and butyral resins.

A conductive layer may still also be provided between the conductive support and the photosensitive layer. In the case when the photosensitive layer has both the subbing layer and the conductive layer, these are usually superposed in the order of the conductive support, the conductive layer, the subbing layer and the photosensitive layer. The conductive layer is commonly constituted of the same binder resin as that used in the subbing layer and the conductive material dispersed in the binder resin.

The electrophotographic photosensitive member used in the present invention may usually be produced by a method in which the subbing layer, the photosensitive layer and the protective layer are superposingly formed on the conductive support by vacuum deposition or coating. In the coating used are a bar coater, a knife coater, a roll coater or an attritor, spraying, dip coating, electrostatic coating and powder coating. Also, to form the subbing layer, photosensitive layer and protective layer by coating, a solution or dispersion prepared for each layer by dissolving or dispersing the constituents of the layer in an organic solvent may be applied by the above method, followed by removal of the solvent by drying or the like. Alternatively, in the case when a reaction-curable binder resin is used, a solution or dispersion prepared by dissolving or dispersing the constituents of the layer in resin materials and a suitable organic solvent optionally added may be applied by the above method, and thereafter the resin materials may be reacted by, e.g., heat or light to cure, further optionally followed by removal of the solvent by drying or the like.

In the present invention, the photosensitive layer 1 may have a surface layer having a resistivity of from $10^{\circ}$ to $10^{14}$ Ω·cm. This is preferable because the injection charging disclosed in, e.g., Japanese Patent Application Laid-Open No. 8-69155 can be materialized and ozone can be prevented from occurring. The reason is that, in the case of the charging accompanied with the generation of ozone, the photosensitive member tends to deteriore due to ozone products when the photosensitive member has a higher mechanical durability as in the present invention, but, in the case of the injection charging, such deterioration does not occur.

(4) Fur-brush Charging Assembly 3

The fur-brush charging assembly 3 which is a contact charging member is of a rotary type in the present example. FIG. 2 shows an enlarged transverse-sectional diagrammatic view of the part including the fur-brush charging assembly 3. As shown in FIG. 2, the fur-brush charging assembly 3 is so provided that fur brush 38 comes in contact with the photosensitive member 1. The fur brush 38 acts as the contact charging member. The fur brush 38 comprises a mandrel 37 of 10 mm in outer diameter to which hair has been set. The fur brush 38 is a brush formed by setting conductive fibers of 3 mm in hair length and $1\times10^{6}$ Ω·cm in resistivity to the mandrel 37 in a density of 15,500 fibers/$cm^2$ (100,000 fibers/$inch^2$). A charging assembly casing 36 has substantially a C-shape in its transverse section, which holds a fur-brush roll consisting of the mandrel 37 and the fur brush 38, and is provided with an electrode 39 on the inner wall surface of the charging assembly casing 36. In the present example, as the electrode 39 a conductive resin material comprising an acrylic resin and adjusted to have a resistivity of $10^3$ to $10^4$ Ω·cm by dispersing carbon black therein is disposed around the fur brush 38.

In this fur-brush charging assembly 3, the fur brush 38, which faces outwards from the opening of the charging assembly casing 36, is brought into contact with the surface of the photosensitive member 1 and is provided substantially in parallel to the photosensitive member 1. In the present example, the fur-brush charging assembly 3 is set so that the fur brush 38 contact nip width (charging zone) n1 formed with respect to the surface of the photosensitive member 1 is about 7 mm.

The mandrel 37 of the fur-brush charging assembly 3 is set to rotate at a speed of 200 mm/sec relative to a peripheral speed 100 mm/sec of the photosensitive member 1, in the clockwise direction b shown by an arrow which is in the direction opposite to (the counter direction of) the rotational direction a of the photosensitive member 1.

To the mandrel 37, a stated charging bias is applied from a charging bias applying power source S1.

In the present example, an oscillating voltage formed by superimposing an alternating voltage (AC; peak-to-peak potential Vpp: 0.7 kV; frequency Vf: 1.0 kHz) on a direct-current (DC) voltage of −700 V is applied as the charging bias (an AC bias application system) to contact-charge the surface of the photosensitive member 1 to about −700 V.

As the mandrel 37 is rotated, the fur brush 38 is rotated in the same direction to rub the surface of the photosensitive member 1 at the charging zone n1, so that electric charges are imparted onto the photosensitive member 1 from the conductive fibers of the fur brush 38. Thus, the surface of the photosensitive member 1 is uniformly contact-charged to the stated polarity and potential.

In the present example, the fur-brush charging assembly 3 used as the contact charging means is a rotary-type charging assembly, but the charging assembly is by no means limited to this construction. Also, the contact charging member does not need to be the fur brush 38, and may be, e.g., a magnetic brush or a charging roller.

The alternating voltage component of primary charging to the contact charging means may have a waveform of sinusoidal waves, rectangular waves or triangular waves, any of which may appropriately be used. For example, a rectangular-wave voltage formed by periodical ON/OFF of a DC power source may be used.

(5) Developing Assembly 4

In general, methods for developing electrostatic latent images are roughly grouped into the following four types.

(a) A method in which a non-magnetic toner is applied on a sleeve by, e.g., a blade, or a magnetic toner is coated on a sleeve by the aid of a magnetic force, and is transported to the developing zone to perform development in the state of non-contact with the photosensitive member (i.e., one-component non-contact development).

(b) A method in which the toner applied in the manner as described above is brought to development in the state of contact with the photosensitive member (i.e., one-component contact development).

(c) A method in which a blend of the toner and a magnetic carrier is used as a two-component developer, and is applied on a sleeve and transported to the developing zone to perform development in the state of contact with the photosensitive member (i.e., two-component contact development).

(d) A method in which the above two-component developer is brought to development in the state of non-contact with the photosensitive member (i.e., two-component non-contact development).

In the present example detailed below, the above method-(c) two-component contact development is employed, but the above other development methods may also be used. Preferably, the method-(b) one-component contact development and method-(c) two-component contact development, in which the developer performs development in the state of contact with the photosensitive member, are effective for improving the effect of simultaneous collection at the time of development. In practice, the method-(c) two-component contact development is widely used in view of high-quality images or high stability.

The developing assembly 4 in the present example is a two-component contact developing assembly (two-component magnetic-brush developing assembly). FIG. 3 shows an enlarged transverse-sectional diagrammatic view of the part including the developing assembly 4. In FIG. 3, reference numeral 41 denotes a developing sleeve driven rotatively in the direction of an arrow c; 42, a magnet roller disposed stationarily inside the developing sleeve 41; 43 and 44, developer agitator screws; 45, a regulation blade disposed in order to form a developer T in a thin layer on the surface of the developing sleeve 41; 46, a developing container; and 47, a replenishing-toner hopper.

The developing sleeve 41 is so disposed as to be about 500 μm close to the photosensitive member 1 at the zone where they stand closest to each other, and is so set that it can perform development in such a state that the developer T thin layer formed on the surface of the developing sleeve 41 comes into contact with the photosensitive member 1. Reference symbol n2 denotes the zone where the developer comes into contact with the photosensitive member 1 (developing zone or developing portion).

The toner used in the present invention may be any toner as long as it has an external additive. From the viewpoint of an improvement in transfer efficiency, those having a larger particle diameter are preferred. In particular, in the cleanerless system as in the present invention, a toner must be used which can achieve a transfer efficiency as high as possible. However, if the toner has too large a particle diameter, e.g., a number-average particle diameter of 0.03 μm or larger, the technical problem assigned to the present invention is hard to solve, i.e., the wear or flaws of the photosensitive member and the faulty images caused thereby tend to occur seriously.

The particle diameter of the external additive in the present invention is measured in the following way.

Using an electron microscope S-800 (manufactured by Hitachi Ltd.), a photograph of the toner magnified 10,000 to 20,000 times is taken. From the external-additive particles thus photographed, 100 to 200 particles are picked up at random in respect of 0.001 μm or larger particles. Their diameters are measured using a measuring device such as a slide gauge, and averaged values are regarded as the number-average particle diameter of the external additive.

The two-component developer T used in the present example is a blend of an external-additive-containing toner t and a magnetic carrier c for developers.

In working examples given later, an external-additive-containing toner prepared by adding an external additive comprised of fine alumina particles and fine silica particles to a negatively chargeable spherical toner (negative toner)

having a weight-average particle diameter of 6 μm, produced by suspension polymerization, was used as the external-additive-containing toner t.

A production example of the developer T used in the present example is shown below.

(i) Production of External-additive-containing Toner t

| | (by weight) |
|---|---|
| Styrene | 125 parts |
| Methyl methacrylate | 35 parts |
| n-Butyl acrylate | 40 parts |
| Copper phthalocyanine pigment | 14 parts |
| Di-tertiary-butylsalicylic acid aluminum compound | 3 parts |
| Saturated polyester (acid value: 10; peak molecular weight: 9,100) | 10 parts |
| Ester wax (weight-average molecular weight Mw: 450; number-average molecular weight Mn: 400; Mw/Mn: 1.13; melting point: 68° C.; viscosity: 6.1 mPa · s; Vickers hardness: 1.2; SP value: 8.3) | 40 parts |

Materials formulated as above were heated to 60° C., and were uniformly dissolved and dispersed at 10,000 rpm by means of a TK-homomixer (manufactured by Tokushu Kika Kogyo). To the resultant mixture, 10 parts by weight of a polymerization initiator 2,2'-azobis(2,4-dimethylvaleronitrile) was added to prepare a polymerizable monomer composition.

Into 710 parts by weight of ion-exchanged water, 450 parts by weight of an aqueous 0.1M-$Na_3PO_4$ solution was introduced, and the mixture obtained was heated to 60° C., followed by stirring at 3,500 rpm by using the TK-homomixer (manufactured by Tokushu Kika Kogyo). Then, 68 parts by weight of an aqueous 1.0M-CaCl2 solution was added thereto to obtain an aqueous medium containing $Ca_3(PO_4)_2$.

Into this aqueous medium, the above polymerizable monomer composition was introduced and 2 parts by weight of polyethylene was further added thereto, and the mixture obtained was stirred at 10,000 rpm for 20 minutes by means of the TK-homomixer to granulate the polymerizable monomer composition. Thereafter, the temperature was raised to 80° C. while stirring the aqueous medium by using a paddle stirring blade, to carry out polymerization reaction for 8 hours.

After the polymerization reaction was completed, the reaction mixture was cooled, and hydrochloric acid was added to dissolve the calcium phosphate, followed by water washing and drying to obtain polymer particles (toner particles).

The external-additive-containing toner t was produced by adding to 100 parts by weight of the toner particles thus obtained, fine alumina particles and fine silica particles in amounts of 1.0 part by weight and 1.0 part by weight, respectively, followed by mixing by the use of a Henschel mixer. The fine alumina particles had been subjected to hydrophobic treatment with an alkylalkoxysilane. The fine alumina particles and the fine silica particles had number-average particle diameters of 0.015 μm and 0.035 μm, respectively.

(ii) Production of Developer T

As the magnetic carrier c, a magnetic carrier having a saturation magnetization of 205 kA/m (205 emu/$cm^3$) and a volume-based 50% particle diameter of 35 μm was used. The above external-additive-containing toner t and this magnetic carrier c were blended in a weight ratio of 6:94. The blend thus obtained was used as the developer T.

The developing sleeve 41 is rotatively driven at a stated peripheral speed in the direction of an arrow c, which is the forward direction with respect to the rotational direction of the photosensitive member at the developing zone n2. With its rotation, the developer T held in the developing container 46 is drawn up on the surface of the developing sleeve 41 by the action of the magnet roller 42 at its pole S2 and is transported. In the course of the transportation, the layer thickness is regulated by the regulation blade 45 disposed vertically to the developing sleeve 41, thus a thin layer of the developer T is formed on the developing sleeve 41. The developer T formed in thin layer is transported by a transport pole N1 to the developing zone n2 corresponding to a development pole S1, whereupon ears are formed by the magnetic force. By the external-additive-containing toner t contained in the developer T formed in ears, the electrostatic latent image on the rotating photosensitive member 1 is developed as a toner image at the developing zone n2. In the present example, the electrostatic latent image is reverse-developed.

With the subsequent rotation of the developing sleeve 41, the developer thin layer on the developing sleeve 41 having passed the developing zone n2 enters the developing container 46, and breaks away from the surface of the developing sleeve 41 by the action of a pole N3/pole N2 repulsion magnetic field, where it is returned to the heap of the developer T.

To the developing sleeve 41, a DC voltage and an AC voltage are applied from a power source S2. In the present example, a voltage is applied which is formed by superimposing an alternating voltage (peak-to-peak potential Vpp: 1,500 V; frequency Vf: 3,000 Hz) on a DC voltage of −480 V.

When the development bias applied to the developing assembly is incorporated with an AC voltage component, the AC voltage component may have a waveform of sinusoidal waves, rectangular waves or triangular waves, any of which may appropriately be used. For example, a rectangular-wave voltage formed by periodical ON/OFF of a DC power source may be used.

In general, in the two-component development, application of an alternating voltage brings about an increase in development efficiency to make images high-quality, but on the other hand there is an undesirable possibility that fog tends to occur. Accordingly, in usual cases, a potential difference is provided between the AC voltage applied to the developing assembly 4 and the surface potential of the photosensitive member 1 to achieve the prevention of fog. More specifically, a bias voltage is applied which has a potential intermediate between the potential of exposed areas and the potential of unexposed areas on the photosensitive member 1.

This potential difference for the prevention of fog is called defogging potential difference (Vback). Such potential difference acts to prevent the toner from adhering to the non-image region (unexposed areas) on the surface of the photosensitive member 1 at the time of developing the surface of the rotating photosensitive member 1, and also, in the apparatus of cleanerless system, acts to collect the transfer residual toner remaining on the surface of the photosensitive member 1 (cleaning-at-development).

A sensor (not shown) for detecting toner concentration of the developer T held in the developing container 46 monitors the toner concentration. Where the toner concentration has become lower than a preset level of concentration as the external-additive-containing toner t in the developer T is consumed on for the development of latent images, the toner is replenished from the replenishing-toner hopper 47 into the developing container 46. By this operation to replenish the toner, the toner concentration of the developer T is always maintained and controlled at the preset level.

(6) Cleanerless System

The printer A of the present example does not have any cleaning assembly (cleaner) exclusively used to remove the transfer residual toner remaining on the surface of the rotating photosensitive member 1 after the toner images have been transferred to the transfer material P, and is an apparatus in the cleanerless system in which the developing assembly 4 are made to serve also as a cleaning means for collecting the transfer residual toner remaining on the surface of the photosensitive member 1.

(1) The transfer residual toner remaining on the surface of the rotating photosensitive member 1 after the toner images have been transferred to the transfer material P is, with the subsequent rotation of the photosensitive member 1, carried to the charging zone n1, which is the part where the photosensitive member 1 comes into contact with the fur brush 38 of the fur-brush charging assembly 3.

(2) At this charging zone n1, the surface of the photosensitive member 1 is rubbed by the fur brush 38 of the fur-brush charging assembly 3, so that the transfer residual toner carried to the charging zone n1 is disturbed and moved on the surface of the photosensitive member 1 until transfer residual toner patterns are scraped and broken down, and also adhered to and mingled with the fur brush 38 to get collected temporarily in the fur-brush charging assembly 3.

(3) The transfer residual toner, having adhered to and mingled with the fur brush of the fur-brush charging assembly 3, is triboelectrically charged by the conductive fibers of the fur brush 38, to be charged again to the regular charge polarity (negative polarity in the present example) together with the toner whose polarity stands reversed. That is, it is turned into a regularly charged toner.

(4) Then, the toner in the fur brush 38, having been turned into a regularly charged toner is sent out onto the photosensitive member 1 by the action of electrical repulsion attributable to the charging bias applied to the fur-brush charging assembly 3.

(5) The toner thus turned into a regularly charged toner and sent out onto the photosensitive member 1 from the fur brush 38 of the fur-brush charging assembly 3 is, with the subsequent rotation of the photosensitive member 1, carried to the developing zone n2, which is the part where the photosensitive member 1 faces the developing sleeve 41 of the developing assembly 4, and is collected by the developing assembly 4 by the action of the defogging potential Vback (cleaning-at-development).

The toner sent out successively from the contact charging means fur-brush charging assembly 3 onto the photosensitive member is usually in a small quantity and in the state of a very thin layer standing scattered uniformly, and does not substantially adversely affect the next step of imagewise exposure. Also, ghost images caused by transfer residual toner patterns are also prevented from occurring.

(7) Photosensitive Member Surface Properties and Running Performance

Usually, since toners have relatively a high electrical resistance, such toner particles having adhered to and mingled with the contact charging member causes an increase in electrical resistance of the contact charging member to inhibit the control of surface potential of the photosensitive member in the step of charging, causing faulty charging and faulty images due to the faulty charging.

Among contact charging means, the fur-brush charging assembly 3 has relatively a large tolerance of the mingling of toner, and hence may preferably be used in the cleanerless system.

However, where the fur-brush contact charging member is used in this cleanerless system, simultaneously with the mingling of toner, the external additive which is an inorganic matter carried on the toner surface may also mingle with the fur-brush contact charging member to rub the surface of the photosensitive member to wear the photosensitive member, resulting in faulty images.

Accordingly, in the present invention, the electrophotographic photosensitive member having the surface properties of the universal hardness of 200 N/mm$^2$ or above (provided that a curve that represents the relationship between hardness and depth of indentation by an indenter has no point of inflection) and a coefficient of surface friction of from 0.01 to 1.2 is used. Thus, the photosensitive member may be kept from flawing and wearing as a result of repeated use so that faulty images can be prevented from occurring.

EXAMPLES

Examples (working examples) of the present invention are given below. In the following Examples, the fur brush is used as the contact charging member. Needless to say, the same effect is obtainable also by the use of a magnetic brush or a charging roller.

Example 1

(1) Production of Photosensitive Member

An OPC (organic photoconductor) photosensitive member used in the present Example was produced with the construction of aluminum cylinder/conductive layer/subbing layer/charge generation layer/charge transport layer/surface protective layer.

(i) Formation of Conductive Layer

| | (by weight) |
|---|---|
| Conductive titanium oxide (coated with tin oxide; number-average particle diameter: 0.4 $\mu$m) | 10 parts |
| Phenolic resin precursor (resol type) | 10 parts |
| Methanol | 10 parts |
| Butanol | 10 parts |

A dispersion obtained by sand mill dispersion of the above materials was applied by dip-coating an aluminum cylinder of 30 mm in outer diameter and 357.5 mm in length, followed by curing at 140° C. to provide a conductive layer having a volume resistivity of $5\times10^9$ Ω·cm and a thickness of 20 $\mu$m.

(ii) Formation of Subbing Layer:

| | (by weight) |
|---|---|
| Methoxymethylated nylon of the following formula (degree of methoxymethylation: about 30%) | 10 parts |
| 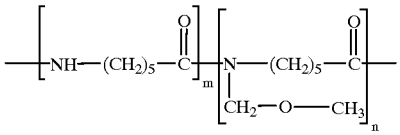 | |
| (wherein m and n each represent a molar ratio; the numerical value of m:n is defined by the degree of methoxymethylation) | |
| Isopropanol | 150 parts |

Next, a solution prepared by mixing the above materials was applied by dip-coating on the conductive layer, followed by drying to provide a subbing layer of 1 μm thick.

(iii) Formation of Charge Generation Layer

Next, 4 parts by weight of oxytitanium phthalocyanine having strong peaks at 9.0°, 14.2°, 23.9° and 27.1° of the diffraction angle (2θ±0.2°) in CuKα a characteristic X-ray diffraction, 2 parts by weight of polyvinyl butyral (trade name: S-LEC BM$^2$; available from Sekisui Chemical Co., Ltd.) and 60 parts by weight of cyclohexanone were dispersed for 4 hours by means of a sand mill making use of glass beads of 1 mm diameter, followed by addition of 100 parts by weight of ethyl acetate to prepare a charge-generation layer dispersion. This dispersion was applied by dip-coating on the subbing layer formed as described above, followed by drying to provide a charge generation layer with a layer thickness of 0.3 μm.

(iv) Formation of Charge Transport Layer

| | (by weight) |
|---|---|
| Triphenylamine of the following formula | 10 parts |
| 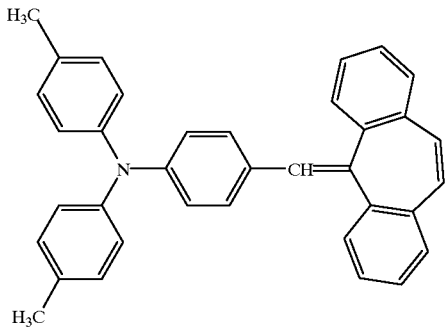 | |
| Polycarbonate resin (bisphenol-Z type; viscosity-average molecular weight: 20,000) | 10 parts |
| Monochlorobenzene | 50 parts |
| Dichloromethane | 15 parts |

Next, a solution prepared by stirring the above materials was applied by dip-coating on the charge generation layer, followed by drying to provide a charge transport layer with a layer thickness of 20 μm.

(v) Formation of Surface Protective Layer

| | (by weight) |
|---|---|
| Acrylic monomer of the following formula | 30 parts |
| 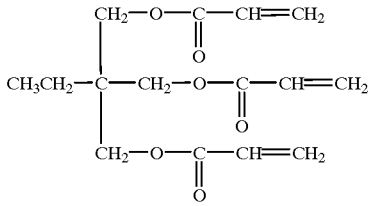 | |
| Ultrafine tin oxide particles having a number-average particle diameter of 40 nm before dispersion | 50 parts |
| Fine polytetrafluoroethylene resin powder (number-average particle diameter: 0.18 μm) | 50 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was 3 μm thick.

The photosensitive member thus produced was used as a photosensitive member A in the production of the following electrophotographic image-forming apparatus.

The surface protective layer of the photosensitive member thus produced was polished by 0.1 μm under pressure while rotating the photosensitive member and bringing a lapping tape #C-2000, available from Fuji Photo Film Co., Ltd., into contact with the drum surface. The photosensitive member whose surface protective layer has been polished is designated as photosensitive member A'.

(vi) Measurement of Surface Properties:

On the photosensitive member A' thus obtained, a surface film properties test was made. Its coefficient of surface friction and contact angle to pure water were also measured. These tests and measurements were all made in the manner as described previously.

As the result, the universal hardness HU was 220 N/mm$^2$, the coefficient of surface friction was 0.06 and the contact angle to pure water was 116 degrees.

(2) Production of Electrophotographic Image-forming Apparatus

The photosensitive member A obtained in the above (1) as a photosensitive member was set in a laser beam printer utilizing a transfer type electrophotographic process and employing a contact charging system, reversal development system and cleanerless system, having the same construction as the electrophotographic image-forming apparatus shown in FIG. 1. Thus, an electrophotographic image-forming apparatus of Example 1 was made up.

(3) Running Test

To evaluate the electrophotographic image-forming apparatus of Example 1, a 10,000-sheet running test was made using an apparatus obtained by setting as a photosensitive member the photosensitive member A in a copying machine GP-55; manufactured by CANON INC., which was so remodeled that its charging assembly was changed to a fur-brush charging assembly and its transfer assembly to a belt type transfer assembly so as to have the same construction as the electrophotographic image-forming apparatus shown in FIG. 1. In this test, used as a developer was the same developer as the two-component developer comprised of the external-additive-containing toner and the magnetic carrier, whose production example was given previously.

As the result, in the 10,000-sheet running test, images which were always good from the beginning to the end were obtainable. This is attributable to the photosensitive member A, which satisfies the above surface properties.

Example 2

An electrophotographic image-forming apparatus of Example 2 was produced in the same manner as in Example 1 except that the photosensitive member A used in the apparatus of Example 1 was replaced with a photosensitive member B obtained in the following way.

(1) Production of Photosensitive Member B and Measurement of Surface Properties

The procedure of Example 1 was repeated until the conductive layer, the subbing layer, the charge generation layer and the charge transport layer were formed in that order on the aluminum cylinder of 30 mm in outer diameter and 357.5 mm in length. Subsequently, a surface protective layer was formed on the charge transport layer in the manner as described below:

| | (by weight) |
|---|---|
| Acrylic monomer of the following formula | 30 parts |
| 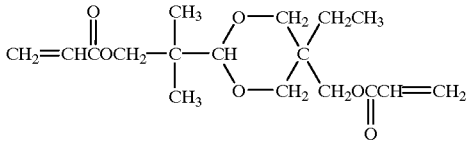 | |
| Ultrafine tin oxide particles having a number-average particle diameter of 40 nm before dispersion | 50 parts |
| Fine polytetrafluoroethylene resin powder (number-average particle diameter: 0.18 $\mu$m) | 4 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was 3 $\mu$m thick.

The photosensitive member thus produced was used as a photosensitive member B in the production of the following electrophotographic image-forming apparatus.

The surface protective layer of the photosensitive member thus produced was polished by 0.1 $\mu$m under pressure while rotating the photosensitive member and bringing a lapping tape #C-2000, available from Fuji Photo Film Co., Ltd., into contact with the drum surface. The photosensitive member whose surface protective layer has been polished is designated as photosensitive member B'.

The surface properties of the photosensitive member B' thus obtained were also measured in the same manner as in Example 1. As the result, the universal hardness HU was 230 N/mm$^2$, the coefficient of surface friction was 0.9 and the contact angle to pure water was 98 degrees.

(2) Running Test

A 10,000-sheet running test was made using an apparatus obtained by setting as a photosensitive member the photosensitive member B in the copying machine GP-55; manufactured by CANON INC., which was remodeled in the same manner as in Example 1. In this test, used as a developer was the same developer as the two-component developer comprised of the external-additive-containing toner and the magnetic carrier, whose production example was given previously.

As the result, in the 10,000-sheet running test, images which were always good from the beginning to the end were obtainable. This is attributable to the photosensitive member B, which satisfies the above surface properties.

Example 3

An electrophotographic image-forming apparatus of Example 3 was produced in the same manner as in Example 1 except that the photosensitive member A used in the apparatus of Example 1 was replaced with a photosensitive member C obtained in the following way.

(1) Production of Photosensitive Member C and Measurement of Surface Properties

The procedure of Example 1 was repeated until the conductive layer, the subbing layer, the charge generation layer and the charge transport layer were formed in that order on the aluminum cylinder of 30 mm in outer diameter and 357.5 mm in length. Subsequently, a surface protective layer was formed on the charge transport layer in the manner as described below:

| | (by weight) |
|---|---|
| Acrylic monomer of the following formula | 30 parts |
| 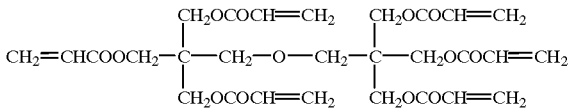 | |
| Ultrafine tin oxide particles having a number-average particle diameter of 40 nm before dispersion | 50 parts |

-continued

| | (by weight) |
|---|---|
| Fine polytetrafluoroethylene resin powder (number-average particle diameter: 0.18 μm) | 35 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was 3 μm thick.

The photosensitive member thus produced was used as a photosensitive member C in the production of the following electrophotographic image-forming apparatus.

The surface protective layer of the photosensitive member thus produced was polished by 0.1 μm under pressure while rotating the photosensitive member and bringing a lapping tape #C-2000, available from Fuji Photo Film Co., Ltd., into contact with the drum surface. The photosensitive member whose surface protective layer has been polished is designated as photosensitive member C'.

The surface properties of the photosensitive member C' thus obtained were also measured in the same manner as in Example 1. As the result, the universal hardness HU was 290 N/mm$^2$, the coefficient of surface friction was 0.3 and the contact angle to pure water was 115 degrees.

(2) Running Test

A 10,000-sheet running test was made using an apparatus obtained by setting as a photosensitive member the photosensitive member C in the copying machine GP-55; manufactured by CANON INC., which was remodeled in the same manner as in Example 1. In this test, used as a developer was the same developer as the two-component developer comprised of the external-additive-containing toner and the magnetic carrier, whose production example was given previously.

As the result, in the 10,000-sheet running test, images which were always good from the beginning to the end were obtainable. This is attributable to the photosensitive member C, which satisfies the above surface properties.

Example 4

An electrophotographic image-forming apparatus of Example 4 was produced in the same manner as in Example 1 except that the photosensitive member A used in the apparatus of Example 1 was replaced with a photosensitive member D obtained in the following way.

(1) Production of Photosensitive Member D and Measurement of Surface Properties

The procedure of Example 1 was repeated until the conductive layer, the subbing layer, the charge generation layer and the charge transport layer were formed in this order on the aluminum cylinder of 30 mm in outer diameter and 357.5 mm in length. Subsequently, a surface protective layer was formed on the charge transport layer in the manner as described below:

| | (by weight) |
|---|---|
| The same acrylic monomer as in Example 1 | 30 parts |
| Ultrafine tin oxide particles having a number-average particle diameter of 40 nm before dispersion | 50 parts |
| Fine polytetrafluoroethylene resin powder (number-average particle diameter: 0.18 μm) | 4 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was in a layer thickness of 3 μm.

The photosensitive member thus produced was used as a photosensitive member D in the production of the following electrophotographic image-forming apparatus.

The surface protective layer of the photosensitive member thus produced was polished by 0.1 μm under application of a pressure while rotating the photosensitive member and bringing a lapping tape #C-2000, available from Fuji Photo Film Co., Ltd., into contact with the drum surface. The photosensitive member whose surface protective layer has been polished is designated as photosensitive member D'.

The surface properties of the photosensitive member D' thus obtained were also measured in the same manner as in Example 1. As the result, the universal hardness HU was 290 N/mm$^2$, the coefficient of surface friction was 1.1 and the contact angle to pure water was 96 degrees.

(2) Running Test

A 10,000-sheet running test was made using an apparatus obtained by setting as a photosensitive member the photosensitive member D in the copying machine GP-55; manufactured by CANON INC., which was remodeled in the same manner as in Example 1. In this test, used as a developer was the same developer as the two-component developer comprised of the external-additive-containing toner and the magnetic carrier, whose production example was given previously.

As the result, in the 10,000-sheet running test, images which were always good from the beginning to the end were obtainable. This is attributable to the photosensitive member D, which satisfies the above surface properties.

Comparative Example 1

An electrophotographic image-forming apparatus of Comparative Example 1 was produced in the same manner as in Example 1 except that the photosensitive member A used in the apparatus of Example 1 was replaced with a photosensitive member E obtained in the following way.

(1) Production of Photosensitive Member E and Measurement of Surface Properties

The procedure of Example 1 was repeated until the conductive layer, the subbing layer, the charge generation layer and the charge transport layer were formed in that order on the aluminum cylinder of 30 mm in outer diameter and 357.5 mm in length. Subsequently, a surface protective layer was formed on the charge transport layer in the manner as described below:

| | (by weight) |
|---|---|
| The same acrylic monomer as in Example 2 | 30 parts |
| Ultrafine tin oxide particles having a number-average particle diameter of 40 nm before dispersion | 50 parts |
| Fine polytetrafluoroethylene resin powder (number-average particle diameter: 0.18 $\mu$m) | 50 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was 3 $\mu$m thick.

The photosensitive member thus produced was used as a photosensitive member E in the production of the following electrophotographic image-forming apparatus.

The surface protective layer of the photosensitive member thus produced was polished by 0.1 $\mu$m under pressure while rotating the photosensitive member and bringing a lapping tape #C-2000, available from Fuji Photo Film Co., Ltd., into contact with the drum surface. The photosensitive member whose surface protective layer has been polished is designated as photosensitive member E'.

The surface properties of the photosensitive member E' thus obtained were also measured in the same manner as in Example 1. As the result, the universal hardness HU was 185 N/mM$^2$, the coefficient of surface friction was 0.03 and the contact angle to pure water was 118 degrees.

(2) Running Test (i) Test made using two-component developer comprised of external-additive-containing toner and magnetic carrier A 10,000-sheet running test was made using an apparatus obtained by setting as a photosensitive member the photosensitive member E in the copying machine GP-55; manufactured by CANON INC., which was remodeled in the same manner as in Example 1. In this test, used as a developer was the same developer as the two-component developer comprised of the external-additive-containing toner and the magnetic carrier, whose production example was given previously.

As the result, in the above running test, the surface of the photosensitive member E became worn seriously causing faulty images due to surface flaws on about 1,000th-sheet running and thereafter, and faulty images due to surface wear on about 5,000th-sheet running and thereafter. This is due to the fact that the photosensitive member E does not satisfy the surface properties specified in the present invention.

(ii) Test made using two-component developer comprised of external-additive-free toner and magnetic carrier.

A running test was made in the same manner as in the above except that, regardless of a lowering of image quality, the above two-component developer comprised of the external-additive-containing toner and the magnetic carrier was replaced with a two-component developer which had no external additive.

As the result, although the surface of the photosensitive member E was barely worn even after the 10,000-sheet running test was made, the image quality was poor. After the 10,000-sheet running was completed, images were further formed using the above two-component developer comprised of the external-additive-containing toner and the magnetic carrier, where good images were obtained.

This shows that the external additive added to the toner particles has an influence on the wear of the photosensitive member surface.

Comparative Example 2

An electrophotographic image-forming apparatus of Comparative Example 2 was produced in the same manner as in Example 1 except that the photosensitive member A used in the apparatus of Example 1 was replaced with a photosensitive member F obtained in the following way.

(1) Production of Photosensitive Member F and Measurement of Surface Properties

The procedure of Example 1 was repeated until the conductive layer, the subbing layer, the charge generation layer and the charge transport layer were formed in that order on the aluminum cylinder of 30 mm in outer diameter and 357.5 mm in length. Subsequently, a surface protective layer was formed on the charge transport layer in the manner as described below:

| | (by weight) |
|---|---|
| The same acrylic monomer as in Example 2 | 30 parts |
| Ultrafine tin oxide particles having a number-average particle diameter of 40 nm before dispersion | 50 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was in a layer thickness of 3 $\mu$m.

The photosensitive member thus produced was used as a photosensitive member F in the production of the following electrophotographic image-forming apparatus.

The surface protective layer of the photosensitive member thus produced was polished by 0.1 $\mu$m under pressure while rotating the photosensitive member and bringing a lapping tape #C-2000, available from Fuji Photo Film Co., Ltd., into contact with the drum surface. The photosensitive member whose surface protective layer has been polished is designated as photosensitive member F'.

The surface properties of the photosensitive member F' thus obtained were also measured in the same manner as in Example 1. As the result, the universal hardness HU was 250 N/mm$^2$, but the coefficient of surface friction was 1.3 and the contact angle to pure water was 90 degrees.

(2) Running Test

A 10,000-sheet running test was made using an apparatus obtained by setting as a photosensitive member the photosensitive member F in the copying machine GP-55; manufactured by CANON INC., which was remodeled in the same manner as in Example 1. In this test, used as a developer was the same developer as the two-component developer comprised of the external-additive-containing toner and the magnetic carrier, whose production example was given previously.

As the result, in the above running test, the surface of the photosensitive member F became worn causing faulty images due to surface flaws on about the 5,000th-sheet running and thereafter. This is due to the fact that the photosensitive member F does not satisfy the surface properties specified in the present invention.

The faulty images due to surface flaws are presumed to have been caused because the lubricating properties of the surface of the photosensitive member F against the fur-brush contact charging member were so low that the external additive, having mingled with the charging member, was strongly pressed against the photosensitive member, rubbing its surface.

Comparative Example 3

An electrophotographic image-forming apparatus of Comparative Example 3 was produced in the same manner as the apparatus of Example 1 except that the photosensitive member A used in the apparatus of Example 1 was replaced with a photosensitive member G obtained in the following way.

(1) Production of Photosensitive Member G and Measurement of Surface Properties

The procedure of Example 1 was repeated until the conductive layer, the subbing layer, the charge generation layer and the charge transport layer were formed in that order on the aluminum cylinder of 30 mm in outer diameter and 357.5 mm in length. Subsequently, a surface protective layer was formed on the charge transport layer in the manner as described below:

| | (by weight) |
|---|---|
| The same acrylic monomer as in Example 3 | 30 parts |
| Ultrafine tin oxide particles having a number-average particle diameter of 40 nm before dispersion | 50 parts |
| Fine polytetrafluoroethylene resin powder (number-average particle diameter: 0.18 $\mu$m) | 200 parts |
| 2-Methylthioxanthone as photopolymerization initiator | 18 parts |
| Ethanol | 150 parts |

A liquid composition prepared by dispersing the above materials for 66 hours by means of a sand mill was applied by dip-coating onto the charge transport layer. The wet coating formed was photo-cured for 60 seconds using a high-pressure mercury lamp at a light intensity of 200 W/cm$^2$, followed by hot-air drying at 120° C. for 2 hours to form a surface protective layer. The surface protective layer thus formed was 3 $\mu$m thick.

The photosensitive member thus produced was used as a photosensitive member G in the production of the following electrophotographic image-forming apparatus.

The surface protective layer of the photosensitive member thus produced was polished by 0.1 $\mu$m under pressure while rotating the photosensitive member and bringing a lapping tape #C-2000, available from Fuji Photo Film Co., Ltd., into contact with the drum surface. The photosensitive member whose surface protective layer has been polished is designated as photosensitive member G'.

The surface properties of the photosensitive member G' thus obtained were also measured in the same manner as in Example 1. As the result, the universal hardness HU was 210 N/mm$^2$, but the coefficient of surface friction was 0.007 and the contact angle to pure water was 120 degrees.

(2) Running Test

A 10,000-sheet running test was made using an apparatus obtained by setting as a photosensitive member the photosensitive member G in the copying machine GP-55; manufactured by CANON INC., which was remodeled in the same manner as in Example 1. In this test, used as a developer was the same developer as the two-component developer comprised of the external-additive-containing toner and the magnetic carrier, whose production example was given previously.

As the result, ghost images caused by transfer of residual toner patterns appeared from the initial stage in the above running test. This is due to the fact that the photosensitive member G does not satisfy the surface properties specified in the present invention.

Such ghost images are presumed to have been caused because the rubbing force barely acted between the surface of the photosensitive member G and the fur-brush contact charging member, so that the transfer residual toner was unable to be scraped off by the charging member.

Surface properties of the photosensitive members A to G obtained in Examples 1 to 4 and Comparative Examples 1 to 3, and the results of the running tests made using them, are summarized in Table 1.

TABLE 1

| | Photo-sensi-tive member | Photosensitive member surface properties: Universal hardness (HU) ($N/mm^2$) | Friction coefficient | Contact angle to pure water (deg.) | Results of running test made using remodeled GP55 |
|---|---|---|---|---|---|
| Example: | | | | | |
| 1 | A | 220 | 0.06 | 116 | Good images were obtainable on up to 10,000 sheets. |
| 2 | B | 230 | 0.9 | 98 | Good images were obtainable on up to 10,000 sheets. |
| 3 | C | 290 | 0.3 | 115 | Good images were obtainable on up to 10,000 sheets. |
| 4 | D | 290 | 1.1 | 96 | Good images were obtainable on up to 10,000 sheets. |
| Comparative Example: | | | | | |
| 1 | E | 185 | 0.03 | 118 | Faulty images due to flaws occurred on about 1,000th sheet ff, and those due to wear about 5,000th sheet ff,. Photosensitive member surface became little worn, but image quality was poor.* |
| 2 | F | 250 | 1.3 | 90 | Faulty images due to flaws occurred on about 5,000th sheet ff,. |
| 3 | G | 210 | 0.007 | 120 | Transfer residual toner pattern ghost occurred from the beginning. |

*Results of a test made using as a developer the two-component developer comprised of an external-additive-free toner and a magnetic carrier.

What is claimed is:

1. An electrophotographic image-forming method comprising a contact charging step of charging the surface of an electrophotographic photosensitive member; an electrostatic latent image forming step of forming an electrostatic latent image on the surface of the electrophotographic photosensitive member charged; a developing step of developing the electrostatic latent image formed, into a toner image; and a transfer step of transferring the toner image formed by the development, from the electrophotographic photosensitive member to a transfer material;

said developing step serving also as a cleaning step for collecting a toner remaining on the electrophotographic photosensitive member after transfer;

said toner containing an external additive; and said electrophotographic photosensitive member having surface properties of universal hardness of 200 $N/mm^2$ or above, wherein a curve that represents the relationship between hardness and depth of indentation by an indenter has no point of inflection, and a coefficient of surface friction of from 0.01 to 1.2.

2. The method according to claim 1, wherein the universal hardness is 220 $N/mm^2$ or above.

3. The method according to claim 1 or 2, wherein the universal hardness is 350 $N/mm^2$ or below.

4. The method according to claim 1, wherein the coefficient of surface friction is from 0.02 to 1.1.

5. The method according to claim 1, wherein said electrophotographic photosensitive member has further surface properties of a contact angle to pure water of 95 degrees or larger.

6. The method according to claim 5, wherein the contact angle is smaller than 120 degrees.

7. The method according to claim 1, wherein said contact charging step is an injection charging step.

8. The method according to claim 1, wherein said external additive has a number-average particle diameter of 0.03 $\mu$m or larger.

9. An electrophotographic image-forming apparatus comprising a contact charging means for charging the surface of an electrophotographic photosensitive member; an electrostatic latent image forming means for forming an electrostatic latent image on the surface of the electrophotographic photosensitive member charged; a developing means for developing the electrostatic latent image formed, into a toner image; and a transfer means for transferring the toner image formed by the development, from the electrophotographic photosensitive member to a transfer material;

said developing means serving also as a cleaning means for collecting a toner remaining on the electrophotographic photosensitive member after transfer;

said toner containing an external additive; and said electrophotographic photosensitive member having surface properties of universal hardness of 200 $N/mm^2$ or above, wherein a curve that represents the relationship between hardness and depth of indentation by an indenter has no point of inflection, and a coefficient of surface friction of from 0.01 to 1.2.

10. The apparatus according to claim 9, wherein the universal hardness is 220 $N/mm^2$ or above.

11. The apparatus according to claim 9 or 10, wherein the universal hardness is 350 $N/mm^2$ or below.

12. The apparatus according to claim 9, wherein the coefficient of surface friction is from 0.02 to 1.1.

13. The apparatus according to claim 9, wherein said electrophotographic photosensitive member has further surface properties of a contact angle to pure water of 95 degrees or larger.

14. The apparatus according to claim 13, wherein the contact angle is smaller than 120 degrees.

15. The apparatus according to claim 9, wherein said contact charging means is an injection charging means.

16. The apparatus according to claim 9, wherein said external additive has a number-average particle diameter of 0.03 $\mu$m or larger.

17. A process cartridge comprising a contact charging means for charging the surface of an electrophotographic photosensitive member; an electrostatic latent image forming means for forming an electrostatic latent image on the surface of the electrophotographic photosensitive member charged; and a developing means for developing the electrostatic latent image formed, into a toner image;

said developing means serving also as a cleaning means for collecting a toner remaining on the electrophotographic photosensitive member after transfer;

said electrophotographic photosensitive member, said contact charging means and said developing means being supported as one unit and being detachably mountable to a main body of an image-forming apparatus;

said toner containing an external additive; and said electrophotographic photosensitive member having surface properties of universal hardness of 200 $N/mm^2$ or above, wherein a curve that represents the relationship between hardness and depth of indentation by an indenter has no point of inflection, and a coefficient of surface friction of from 0.01 to 1.2.

18. The process cartridge according to claim 17, wherein the universal hardness is 220 $N/mm^2$ or above.

19. The process cartridge according to claim 17 or 18, wherein the universal hardness is 350 $N/mm^2$ or below.

20. The process cartridge according to claim 17, wherein the coefficient of surface friction is from 0.02 to 1.1.

21. The process cartridge according to claim 17, wherein said electrophotographic photosensitive member has further surface properties of a contact angle to pure water of 95 degrees or larger.

22. The process cartridge according to claim 21, wherein the contact angle is smaller than 120 degrees.

23. The process cartridge according to claim 17, wherein said contact charging means is an injection charging means.

24. The process cartridge according to claim 17, wherein said external additive has a number-average particle diameter of 0.03 $\mu$m or larger.

* * * * *

UNITED STATES PATENT AND TRADEMARK OFFICE

CERTIFICATE OF CORRECTION

PATENT NO. : 6,215,971 B1
DATED : April 10, 2001
INVENTOR(S) : Harumi Sakoh et al.

It is certified that error appears in the above-identified patent and that said Letters Patent is hereby corrected as shown below:

Column 1,
Line 15, "apparatus" should read -- apparatus --.

Column 3,
Line 27, "appratus" should read -- apparatus --.

Column 4,
Line 60, "an" should read -- a --.

Column 7,
Line 40, "very" should be deleted.

Column 9,
Line 8, "on on" shouhd read -- on --.
Line 39, "on on" should read -- on --.
Line 47, "on " should read deleted.

Column 10,
Line 15, "on to" should read -- onto --.

Column 14,
Line 40, "$10^{0}$" should read -- $10^{9}$ --; and
Line 46, "deteriore" should read -- deteriorate --.

Column 18,
Line 65, "on" should be deleted.

Column 19,
Line 12, "are" should read -- is --.

Column 20,
Line 1, "causes" should read -- cause --.

Column 21,
Line 26, "a" should be deleted.

Column 27,
Line 50, "$N/mM^2$," should read -- $N/mm^2$,--.

UNITED STATES PATENT AND TRADEMARK OFFICE

CERTIFICATE OF CORRECTION

PATENT NO. : 6,215,971 B1
DATED : April 10, 2001
INVENTOR(S) : Harumi Sakoh et al.

It is certified that error appears in the above-identified patent and that said Letters Patent is hereby corrected as shown below:

Column 29,
Line 23, "worn" should read -- worn, --.

Column 31, Table 1,
Comp. Ex. 1, "ff" should read -- ff. --; and
Comp. Ex. 2, "ff,." should read -- ff. --; and
Line 38, "formed," should read -- formed --; and
Line 40, "development," should read -- development --.

Column 32,
Line 38, "formed," should read -- formed --; and
Line 40, "development," should read -- development --.

Column 33,
Line 7, "formed," should read -- formed --.

Signed and Sealed this

Fourth Day of December, 2001

*Attest:*

Nicholas P. Godici

NICHOLAS P. GODICI
*Acting Director of the United States Patent and Trademark Office*

*Attesting Officer*